US007168786B2

(12) United States Patent
Tanaka et al.

(10) Patent No.: US 7,168,786 B2
(45) Date of Patent: Jan. 30, 2007

(54) INK-JETTING RECORDING APPARATUS AND LIQUID EJECTING APPARATUS

(75) Inventors: Ryoichi Tanaka, Nagano-Ken (JP); Akira Takagi, Nagano-Ken (JP); Hirokazu Nunokawa, Nagano-Ken (JP); Katsuhiro Okubo, Nagano-Ken (JP); Tatsuya Nakano, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 248 days.

(21) Appl. No.: 10/995,944

(22) Filed: Nov. 24, 2004

(65) Prior Publication Data

US 2005/0200641 A1 Sep. 15, 2005

(30) Foreign Application Priority Data

Nov. 26, 2003 (JP) ..... 2003-395557
Feb. 24, 2004 (JP) ..... 2004-047867
Nov. 22, 2004 (JP) ..... 2004-337740

(51) Int. Cl.
*B41J 2/21* (2006.01)

(52) U.S. Cl. ..... 347/43; 347/41; 347/15

(58) Field of Classification Search ..... 347/15, 347/43, 41, 40, 12, 16
See application file for complete search history.

(56) References Cited

U.S. PATENT DOCUMENTS 5,844,585 A * 12/1998 Kurashima et al. ..... 347/43
6,089,697 A * 7/2000 Tajika et al. ..... 347/43
6,896,357 B2 * 5/2005 Murakami et al. ..... 347/43

FOREIGN PATENT DOCUMENTS

| | | | |
|---|---|---|---|
| EP | 0 554 907 | A2 | 8/1993 |
| EP | 0 661 156 | A2 | 7/1995 |
| EP | 0 812 692 | A2 | 12/1997 |
| JP | 4-290751 | A | 10/1992 |
| JP | 6-171084 | A | 6/1994 |
| JP | 8-39798 | A | 2/1996 |
| JP | 2002-113852 | A | 4/2002 |

* cited by examiner

*Primary Examiner*—Lamson Nguyen
(74) *Attorney, Agent, or Firm*—Sughrue Mion, PLLC

(57) ABSTRACT

A plurality of nozzles forms the first row of nozzles, the second row of nozzles, the third row of nozzles and the fourth row of nozzles, which extend in parallel with a sub scanning direction. A black ink is adapted to be supplied to one row of nozzles. Color inks are adapted to be supplied to the other rows of nozzles, the color inks being different for each of the other rows of nozzles. Positions of the second row of nozzles to the fourth row of nozzles are shifted by ⅓ or ⅔ of an arrangement pitch of the nozzles, in the sub scanning direction, for each of the rows of nozzles, with respect to positions of the first row of nozzles. In a high-speed black mode, the color inks are ejected from corresponding nozzles, in connection with ink ejection of the black ink from corresponding nozzles.

20 Claims, 13 Drawing Sheets

INK-JETTING RECORDING APPARATUS AND LIQUID EJECTING APPARATUS

FIELD OF THE INVENTION

This invention relates to a liquid ejecting apparatus for ejecting a drop of liquid from a nozzle. In particular, this invention is related to an ink-jetting recording apparatus for ejecting a plurality of ink drops from a plurality of nozzles wherein the plurality of ink drops has different colors.

BACKGROUND OF THE INVENTION

In an ink-jetting recording apparatus such as an ink-jetting printer or an ink-jetting plotter, a recording head is caused to move in a main scanning direction, and a recording paper (a kind of recording medium) is caused to move in a sub-scanning direction. In cooperation with those movements, a drop of ink can be ejected from a nozzle of the recording head onto the recording paper. Thus, an image (including a character or the like) can be recorded on the recording paper. For example, the drop of ink can be ejected by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is ejected from the nozzle.

In such a recording apparatus, a driving signal consisting of a series of a plurality of pulses-waves is generated. On the other hand, printing data including level (gradation) information can be transmitted to the recording head. Then, based on the transmitted printing data, only necessary one or more pulse-waves are selected from the driving signal and supplied to the piezoelectric vibrating member. Thus, a volume of the ink ejected from the nozzle may be changed based on the level information.

On the other hand, in a recording head for color printing, a plurality of rows of nozzles is alongside arranged for respectively ejecting a plurality of color inks. When the respective color inks are suitably ejected to be overlapped, the color recording is desirably achieved. The plurality of color inks are, for example, a black ink, a cyan ink, a magenta ink, and a yellow ink.

For example, in an example shown in FIG. 13, in a recording head for color printing, a row of nozzles for ejecting a black ink (BK), a row of nozzles for ejecting a cyan ink (C), a row of nozzles for ejecting a magenta ink (M) and a row of nozzles for ejecting a yellow ink (Y) are arranged alongside in this order.

The nozzle pitch of each row of nozzles of FIG. 13 is 120 dpi. In order to achieve a recording density of 360 dpi in the recording head, it is sufficient to divide one nozzle pitch into three and to carry out a three-path main scanning operation. Thus, if a resolution in a main scanning direction is also set at 360 dpi, a resolution of 360×360 dpi can be obtained (normal mode).

On the other hand, for the purpose of printing a draft document or the like, a higher-speed recording operation may be desired. In this case, high printing quality is not required. In such a case, only a black ink is used, and a one-path main scanning operation is carried out for one nozzle pitch. That is, since a resolution in a sub scanning direction is maintained at 120 dpi, a dot resolution is 360×120 dpi (high-speed black mode).

In general, a plurality of nozzles is formed in a matrix pattern as shown in FIG. 13. However, each row of nozzles may be shifted for various purposes (JP Laid-Open Publication No. Hei4-290751; JP Laid-Open Publication No. Hei6-171084; JP Laid-Open Publication No. Hei8-39798; and JP Laid-Open Publication No. 2002-113852).

SUMMARY OF THE INVENTION

As described above, in an ink-jetting recording apparatus that can carry out a color printing operation, two modes of a normal mode for the color printing operation or the like and a high-speed black mode (draft mode) are prepared.

In a conventional high-speed black mode, quality is sacrificed for high-speed recording, so that a dot resolution is limited to 360×120 dpi. Thus, gap lines as shown in FIG. 14 may be perceived.

The object of this invention is to solve the above problems, that is, to provide a liquid ejecting apparatus such as an ink-jet recording apparatus wherein gap lines as shown in FIG. 14 may not be perceived even in a high-speed black mode.

This invention is an ink-jetting recording apparatus comprising: a recording head having a plurality of nozzles; a plurality of pressure-changing units, each of which changes a pressure of ink in each of the plurality of nozzles so as to eject the ink; a main scanning unit that causes the recording head to move in a main scanning direction relatively to a recording medium; a sub scanning unit that causes the recording medium to move in a sub scanning direction relatively to the recording head, the sub scanning direction being perpendicular to the main scanning direction; a driving-signal outputting unit that outputs a driving signal for each of the plurality of pressure-changing units; a main controller that controls the main scanning unit, the sub scanning unit and the driving-signal outputting unit in order to eject the ink from each of the plurality of nozzles to a predetermined position on the recording medium, based on recording data; and a mode-selecting part that selects one from a normal mode and a high-speed black mode; wherein the plurality of nozzles forms a first row of nozzles, a second row of nozzles, a third row of nozzles and a fourth row of nozzles, which extend in parallel with the sub scanning direction; a black ink is adapted to be supplied to one row of nozzles among the first row of nozzles to the fourth row of nozzles; color inks are adapted to be supplied to the other rows of nozzles among the first row of nozzles to the fourth row of nozzles, the color inks being different for each of the other rows of nozzles; an arrangement pitch of nozzles is the same for each of the rows of nozzles; positions of one row of nozzles among the second and third rows of nozzles are shifted in the sub scanning direction by ⅓ of the arrangement pitch of nozzles with respect to positions of the first row of nozzles; positions of the other row of nozzles among the second and third rows of nozzles are shifted in the sub scanning direction by ⅔ of the arrangement pitch of nozzles with respect to the positions of the first row of nozzles; positions of the fourth row of nozzles are shifted in the sub scanning direction by ⅓ or ⅔ of the arrangement pitch of nozzles with respect to the positions of the first row of nozzles;

when the normal mode is selected by the mode-selecting part, the main controller controls the main scanning unit and the sub scanning unit: so as to cause the recording medium to move in the sub scanning direction relatively to the recording head by ⅓ of the arrangement pitch of nozzles, after a first movement in the scanning direction of the recording head relatively to the recording medium; to cause the recording medium to move in the sub scanning direction relatively to the recording head by ⅓ of the arrangement pitch of nozzles, after the next one movement in the scanning direction of the recording head relatively to the recording medium as well; and to cause the recording medium to move in the sub scanning direction relatively to the recording head by a difference between a nozzle-row pitch in the sub scanning direction and ⅔ of the arrangement pitch of nozzles, after the next one movement in the scanning direction of the recording head relatively to the recording medium, the nozzle-row pitch corresponding to a product of the number of nozzles in each row of nozzles and the arrangement pitch of nozzles, when the high-speed black mode is selected by the mode-selecting part, the main controller controls the main scanning unit and the sub scanning unit: so as to cause the recording medium to move in the sub scanning direction relatively to the recording head by the nozzle-row pitch in the sub scanning direction, after each movement in the scanning direction of the recording head relatively to the recording medium, when the normal mode is selected by the mode-selecting part, the main controller serves to eject the ink from each nozzle of the first row of nozzles toward the medium based on recording data for each nozzle of the first row of nozzles, to eject the ink from each nozzle of the second row of nozzles toward the medium based on recording data for each nozzle of the second row of nozzles, to eject the ink from each nozzle of the third row of nozzles toward the medium based on recording data for each nozzle of the third row of nozzles, and to eject the ink from each nozzle of the fourth row of nozzles toward the medium based on recording data for each nozzle of the fourth row of nozzles, during each movement in the scanning direction of the recording head relatively to the recording medium, and when the high-speed black mode is selected by the mode-selecting part, the main controller serves to eject the black ink from each nozzle of the row of nozzles to which the black ink is supplied, toward the medium, based on recording data for each nozzle of the row of nozzles, and to eject the respective color inks from each corresponding nozzle of the other rows of nozzles toward the medium, based on the recording data.

According to the invention, the respective color inks are ejected to an area corresponding to gap lines (see FIG. 14) generated in a conventional high-speed black mode, to fill the area. Thus, it can be prevented that such a gap line is perceived. Since the respective color inks are ejected with the black ink, color tone of recorded characters, images or the like is not complete black. However, visibility thereof is not so inferior. (Actually, by an experiment using various images, it has been confirmed that images recorded by the high-speed black mode of the present invention are much more beautiful than by the conventional one).

For example, the arrangement pitch of nozzles is 120 dpi. In the case, a resolution of 360×360 dpi can be achieved in the normal mode, and also a resolution of 360×360 dpi can be semblably achieved in the high-speed black mode. That is, recording quality is remarkably improved, compared with the resolution of 360×120 dpi of the conventional high-speed black mode.

When the pressure-changing unit includes a bending-mode piezoelectric vibrating member, that is, when the recording head is a type of Chips-series, it is general that the arrangement pitch of nozzles is 120 dpi. (At present, for a recording head of a type of Chips-series, in view of manufacture thereof, it is difficult to achieve an arrangement density of nozzles higher than 120 dpi.)

Preferably, when the high-speed black mode is selected by the mode-selecting part, the main controller serves to eject each ink from each nozzle of each row of nozzles in such a manner that a relative proportion of volume of the ejected ink coincides with a predetermined proportion.

Herein, the predetermined proportion is a desired proportion set so as to make the color tone of recorded characters, images or the like closer to black.

Specifically, in the high-speed black mode, when the volume of an ejected black ink is 100%, if magenta and yellow are arranged on the same main scanning line (if the row of nozzles for magenta and the row of nozzles for yellow have the same track in the main scanning direction), the volume of an ejected cyan ink may be 100%, the volume of an ejected magenta ink may be 70 to 85%, and the volume of an ejected yellow ink may be 70 to 85%. In the case, reddishness of the color tone is inhibited.

Similarly, if cyan and yellow are arranged on the same main scanning line (if the row of nozzles for cyan and the row of nozzles for yellow have the same track in the main scanning direction), the volume of an ejected cyan ink may be 70 to 85%, the volume of an ejected magenta ink may be 100%, and the volume of an ejected yellow ink may be 70 to 85%. In the case, greenishness of the color tone is inhibited.

Alternatively, if yellow and black are arranged on the same main scanning line (if the row of nozzles for yellow and the row of nozzles for black have the same track in the main scanning direction), the volume of an ejected cyan ink may be 100%, the volume of an ejected magenta ink may be 100%, and the volume of an ejected yellow ink may be 70 to 85%.

In addition, this invention is a controlling unit for controlling an ink-jetting recording apparatus including: a recording head having a plurality of nozzles; a plurality of pressure-changing units, each of which changes a pressure of ink in each of the plurality of nozzles so as to eject the ink; a main scanning unit that causes the recording head to move in a main scanning direction relatively to a recording medium; a sub scanning unit that causes the recording medium to move in a sub scanning direction relatively to the recording head, the sub scanning direction being perpendicular to the main scanning direction; a driving-signal outputting unit that outputs a driving signal for each of the plurality of pressure-changing units; and a mode-selecting part that selects one from a normal mode and a high-speed black mode; wherein the plurality of nozzles forms a first row of nozzles, a second row of nozzles, a third row of nozzles and a fourth row of nozzles, which extend in parallel with the sub scanning direction; a black ink is adapted to be supplied to one row of nozzles among the first row of nozzles to the fourth row of nozzles; color inks are adapted to be supplied to the other rows of nozzles among the first row of nozzles to the fourth row of nozzles, the color inks being different for each of the other rows of nozzles; an arrangement pitch of nozzles is the same for each of the rows of nozzles; positions of one row of nozzles among the second and third rows of nozzles are shifted in the sub scanning direction by ⅓ of the arrangement pitch of nozzles with respect to positions of the first row of nozzles; positions of the other row of nozzles among the second and third rows of nozzles are shifted in the sub scanning direction by ⅔ of the arrangement pitch of nozzles with respect to the positions of the first row of nozzles; positions of the fourth row of nozzles are shifted in the sub scanning direction by ⅓ or ⅔ of the arrangement pitch of nozzles with respect to the positions of the first row of nozzles;

when the normal mode is selected by the mode-selecting part, the controlling unit being adapted to control the main scanning unit and the sub scanning unit: so as to cause the recording medium to move in the sub scanning direction relatively to the recording head by ⅓ of the arrangement pitch of nozzles, after a first movement in the scanning direction of the recording head relatively to the recording medium; to cause the recording medium to move in the sub scanning direction relatively to the recording head by ⅓ of the arrangement pitch of nozzles, after the next one movement in the scanning direction of the recording head relatively to the recording medium as well; and to cause the recording medium to move in the sub scanning direction relatively to the recording head by a difference between a nozzle-row pitch in the sub scanning direction and ⅔ of the arrangement pitch of nozzles, after the next one movement in the scanning direction of the recording head relatively to the recording medium, the nozzle-row pitch corresponding to a product of the number of nozzles in each row of nozzles and the arrangement pitch of nozzles, and the controlling unit being adapted to serve to eject the ink from each nozzle of the first row of nozzles toward the medium based on recording data for each nozzle of the first row of nozzles, to eject the ink from each nozzle of the second row of nozzles toward the medium based on recording data for each nozzle of the second row of nozzles, to eject the ink from each nozzle of the third row of nozzles toward the medium based on recording data for each nozzle of the third row of nozzles, and to eject the ink from each nozzle of the fourth row of nozzles toward the medium based on recording data for each nozzle of the fourth row of nozzles, during each movement in the scanning direction of the recording head relatively to the recording medium, when the high-speed black mode is selected by the mode-selecting part, the controlling unit being adapted to control the main scanning unit and the sub scanning unit: so as to cause the recording medium to move in the sub scanning direction relatively to the recording head by the nozzle-row pitch in the sub scanning direction, after each movement in the scanning direction of the recording head relatively to the recording medium, and the controlling unit being adapted to serve to eject the black ink from each nozzle of the row of nozzles to which the black ink is supplied, toward the medium, based on recording data for each nozzle of the row of nozzles, and to eject the respective color inks from each corresponding nozzle of the other rows of nozzles toward the medium, based on the recording data.

Preferably, when the high-speed black mode is selected by the mode-selecting part, the controlling unit serves to eject each ink from each nozzle of each row of nozzles in such a manner that a relative proportion of volume of the ejected ink coincides with a predetermined proportion.

The above controlling unit can be materialized by a computer system.

A program for materializing the respective units or the respective means in the computer system, and a storage medium storing the program capable of being read by a computer, should be protected by the application as well.

The storage unit may be not only a substantial object such as a floppy disk or the like, but also a network for transmitting various signals.

The above description is about an invention relating to an ink-jetting recording apparatus. However, ejected liquid is not limited to ink. That is, as a broader concept, this invention is a liquid ejecting apparatus comprising: a head member having a plurality of nozzles; a plurality of liquid ejecting units, each of which ejects a liquid in each of the plurality of nozzles; a main scanning unit that causes the head member to move in a main scanning direction relatively to a medium to which the liquid is ejected; a sub scanning unit that causes the medium to move in a sub scanning direction relatively to the head member, the sub scanning direction being perpendicular to the main scanning direction; a driving-signal outputting unit that outputs a driving signal for each of the plurality of liquid ejecting units; a main controller that controls the main scanning unit, the sub scanning unit and the driving-signal outputting unit in order to eject the liquid from each of the plurality of nozzles to a predetermined position on the medium based on effecting data; and a mode-selecting part that selects one from a normal mode and a high-speed black mode; wherein the plurality of nozzles forms n rows of nozzles extending in parallel with the sub scanning direction, n being three or more; a black liquid is adapted to be supplied to one row of nozzles among the n rows of nozzles; color liquids are adapted to be supplied to the other rows of nozzles among the n rows of nozzles, the color liquids being different for each of the other rows of nozzles; an arrangement pitch of nozzles is the same for each of the rows of nozzles; positions of m rows of nozzles among the n rows of nozzles are shifted in the sub scanning direction by every 1/m of the arrangement pitch of nozzles for each of the m rows of nozzles, m being not less than three and not more than n;

when the normal mode is selected by the mode-selecting part, the main controller controls the main scanning unit and the sub scanning unit: so as to cause the medium to move in the sub scanning direction relatively to the head member by 1/m of the arrangement pitch of nozzles, after each of first to (m−1)-th movements in the scanning direction of the head member relatively to the medium; and to cause the medium to move in the sub scanning direction relatively to the head member by a difference between a nozzle-row pitch in the sub scanning direction and ((m−1))/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles, when the high-speed black mode is selected by the mode-selecting part, the main controller controls the main scanning unit and the sub scanning unit: so as to cause the medium to move in the sub scanning direction relatively to the head member by the nozzle-row pitch in the sub scanning direction, after each movement in the scanning direction of the head member relatively to the medium, when the normal mode is selected by the mode-selecting part, the main controller serves to eject each liquid from each nozzle of each row of nozzles toward the medium, based on ejecting data for each nozzle of each row of nozzles, during each movement in the scanning direction of the head member relatively to the medium, and when the high-speed black mode is selected by the mode-selecting part, the main controller serves to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

Alternatively, this invention is a program executed by a computer system including at least a computer in order to materialize a controlling unit in the computer system, the controlling unit controlling a liquid ejecting apparatus including: a head member having a plurality of nozzles; a plurality of liquid ejecting units, each of which ejects a liquid in each of the plurality of nozzles; a main scanning unit that causes the head member to move in a main scanning direction relatively to a medium to which the liquid is ejected; a sub scanning unit that causes the medium to move in a sub scanning direction relatively to the head member, the sub scanning direction being perpendicular to the main scanning direction; a driving-signal outputting unit that outputs a driving signal for each of the plurality of liquid ejecting units; and a mode-selecting part that selects one from a normal mode and a high-speed black mode; wherein the plurality of nozzles forms n rows of nozzles extending in parallel with the sub scanning direction, n being three or more; a black liquid is adapted to be supplied to one row of nozzles among the n rows of nozzles; color liquids are adapted to be supplied to the other rows of nozzles among the n rows of nozzles, the color liquid being different for each of the other rows of nozzles; an arrangement pitch of nozzles is the same for each of the rows of nozzles; positions of m rows of nozzles among the n rows of nozzles are shifted in the sub scanning direction by every 1/m of the arrangement pitch of nozzles for each of the m rows of nozzles, m being not less than three and not more than n;

when the normal mode is selected by the mode-selecting part, the controlling unit being adapted to control the main scanning unit and the sub scanning unit: so as to cause the medium to move in the sub scanning direction relatively to the head member by 1/m of the arrangement pitch of nozzles, after each of first to (m−1)-th movements in the scanning direction of the head member relatively to the medium; and to cause the medium to move in the sub scanning direction relatively to the head member by a difference between a nozzle-row pitch in the sub scanning direction and (m−1)/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles; and the controlling unit being adapted to serve to eject each liquid from each nozzle of each row of nozzles toward the medium, based on ejecting data for each nozzle of each row of nozzles, during each movement in the scanning direction of the head member relatively to the medium;

when the high-speed black mode is selected by the mode-selecting part, the controlling unit being adapted to control the main scanning unit and the sub scanning unit: so as to cause the medium to move in the sub scanning direction relatively to the head member by the nozzle-row pitch in the sub scanning direction, after each movement in the scanning direction of the head member relatively to the medium; and the controlling unit being adapted to serve to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

Alternatively, this invention is a liquid ejecting apparatus comprising: a head member including a plurality of rows of nozzles for ejecting liquid; wherein the plurality of rows of nozzles includes at least n rows of nozzles in a main scanning direction, which is a relative movement direction of the head member and a medium to which the liquid is ejected when the liquid is ejected, n being three or more; the nozzles in each row of nozzles are arranged in a sub scanning direction at the same common pitch, the sub scanning direction being perpendicular to the main scanning direction; positions of m rows of nozzles among the at least n rows of nozzles are shifted in the sub scanning direction by every 1/m of the pitch for each of the m rows of nozzles, m being not less than three and not more than n; a black liquid is adapted to be supplied to one row of nozzles among the rows of nozzles; color liquids are adapted to be supplied to the other rows of nozzles among the rows of nozzles; a normal mode and a high-speed black mode are selectively used; in the normal mode, liquid ejected from each row of nozzles is adapted to be interpolated by the liquid ejected from the row of nozzles, by every ⅓ of the pitch, in the sub scanning direction; and in the high-speed black mode, the black liquid is adapted to be interpolated by the color liquids, by every ⅓ of the pitch, in the sub scanning direction.

Preferably, an arrangement pitch of nozzles is the same for each of the rows of nozzles.

In addition, preferably, four rows of nozzles are included in the head member, two rows of nozzles among the four rows of nozzles are arranged in the same manner in the sub scanning direction.

BEST MODE FOR CARRYING OUT THE INVENTION

An embodiment of the invention will now be described with reference to drawings.

Figure 1:
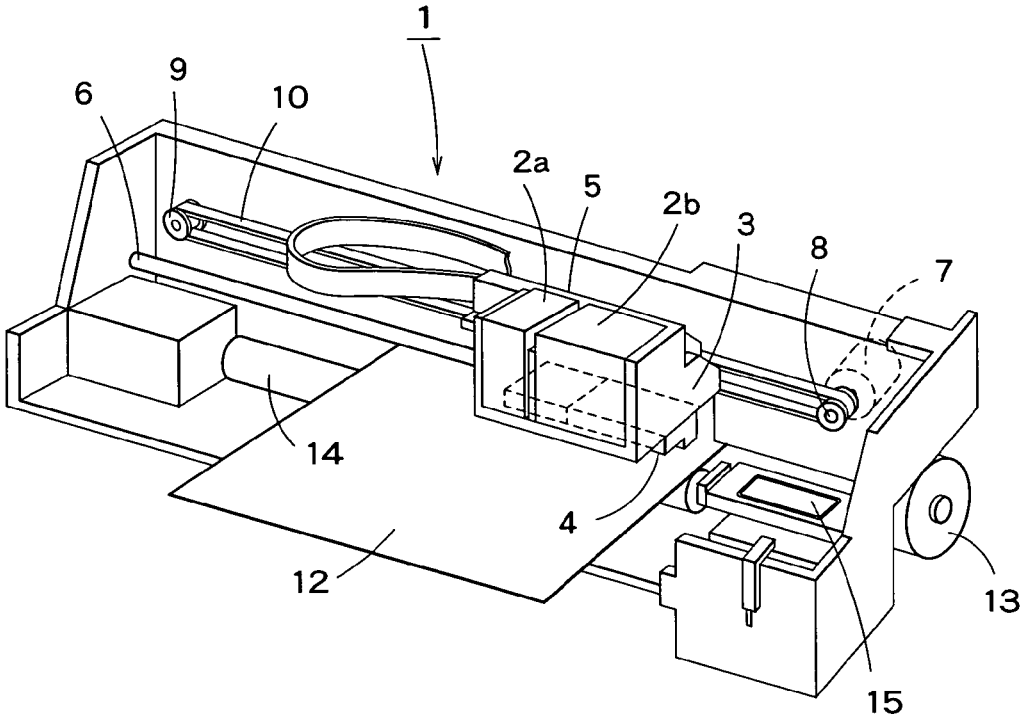
FIG. 1 is a schematic perspective view of an ink-jetting recording apparatus of an embodiment according to the invention.

As shown in FIG. 1, an ink-jetting recording apparatus of the present embodiment (an example of liquid ejecting apparatus) is an ink-jetting printer 1. The ink-jetting printer 1 includes a carriage 5, which has a recording head 4 (an example of head member) and a cartridge holder 3 capable of holding a black-ink cartridge 2*a* and a color-ink cartridge 2*b*. The carriage 5 is adapted to be reciprocated in a main scanning direction by a head-scanning mechanism (an example of main scanning unit).

The head-scanning mechanism is formed by: a guide bar 6 horizontally extending in a housing, a pulse motor 7 arranged at a side portion of the housing, a driving pulley 8 connected to a rotational shaft of the pulse motor 7, a free pulley 9 mounted at the other side portion of the housing, a timing belt 10 connected to the carriage 5 and going around the driving pulley 8 and the free pulley 9, and a controller 11 (see FIG. 4) for controlling the pulse motor 7. Thus, the carriage 5 i.e. the recording head 4 can be reciprocated in the main scanning direction i.e. in a width direction of a recording paper 12, by driving the pulse motor 7.

In addition, the printer 1 includes a paper feeding mechanism (an example of sub scanning unit) for feeding the recording paper 12 or any other recording medium (a medium onto which the ink is ejected) in a feeding direction (sub-scanning direction). The paper feeding mechanism consists of a paper feeding motor 13, a paper feeding roller 14 or the like. The recording paper 12 or other recording medium is fed in turn, in cooperation with the recording operation.

Figure 2:
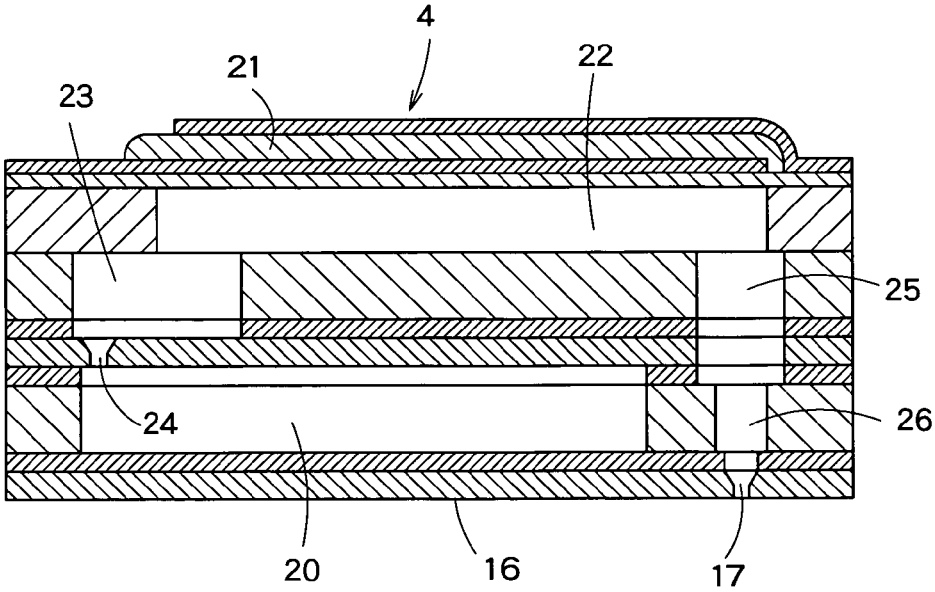
FIG. 2 is a sectional view for explaining a structure of a recording head.

As shown in FIG. 2, the recording head 4 mainly has: an ink chamber 20 to which an ink are supplied from the ink cartridge 2*a* or 2*b* (see FIG. 1); a nozzle plate 16 provided with a plurality of nozzles 17 in a sub-scanning direction; and a plurality of pressure chambers 22 communicated with the plurality of nozzles 17, respectively. Each of the plurality of pressure chambers 22 is adapted to be caused to expand and contract by deformation of a piezoelectric vibrating member 21.

The ink chamber 20 and the plurality of pressure chambers 22 are communicated via a plurality of ink supplying holes 24 and a plurality of supply side communication holes 23, respectively. The plurality of pressure chambers 22 and the plurality of nozzles 17 are communicated via a plurality of first nozzle side communication holes 25 and a plurality of second nozzle side communication holes 26, respectively. Thus, for each of the plurality of nozzles 17, an ink passage is formed from the ink chamber 20 to each of the plurality of nozzles 17 via each of the plurality of pressure chambers 22.

The piezoelectric vibrating member 21 is a so-called bending-mode (distortion mode) of piezoelectric vibrating member. If the bending-mode of piezoelectric vibrating member 21 is used, when charged, the piezoelectric vibrating member 21 contracts in a direction perpendicular to a direction of the electric field. Then, a pressure chamber 22 corresponding to the piezoelectric vibrating member 21 is caused to contract. When the electric charges are discharged from the piezoelectric vibrating member 21, the piezoelectric vibrating member 21 extends in the direction perpendicular to the direction of the electric field. Then, the pressure chamber 22 corresponding to the piezoelectric vibrating member 21 is caused to expand.

That is, in the recording head 4, a volume of the pressure chamber 22 may be changed by the corresponding piezoelectric vibrating member 21 charged or discharged. This may cause pressure of the ink in the pressure chamber 22 to change, so that a drop of the ink may be ejected from the corresponding nozzle 17 or a meniscus (free surface of the ink exposed at the nozzle 17) may be caused to minutely vibrate.

In the case, the recording head 4 is a many-color-recording head that is capable of recording with a different plurality of colors. Thus, the recording head 4 has a plurality of head units. Respective predetermined colors are set for and used in the plurality of head units, respectively.

Figure 3:
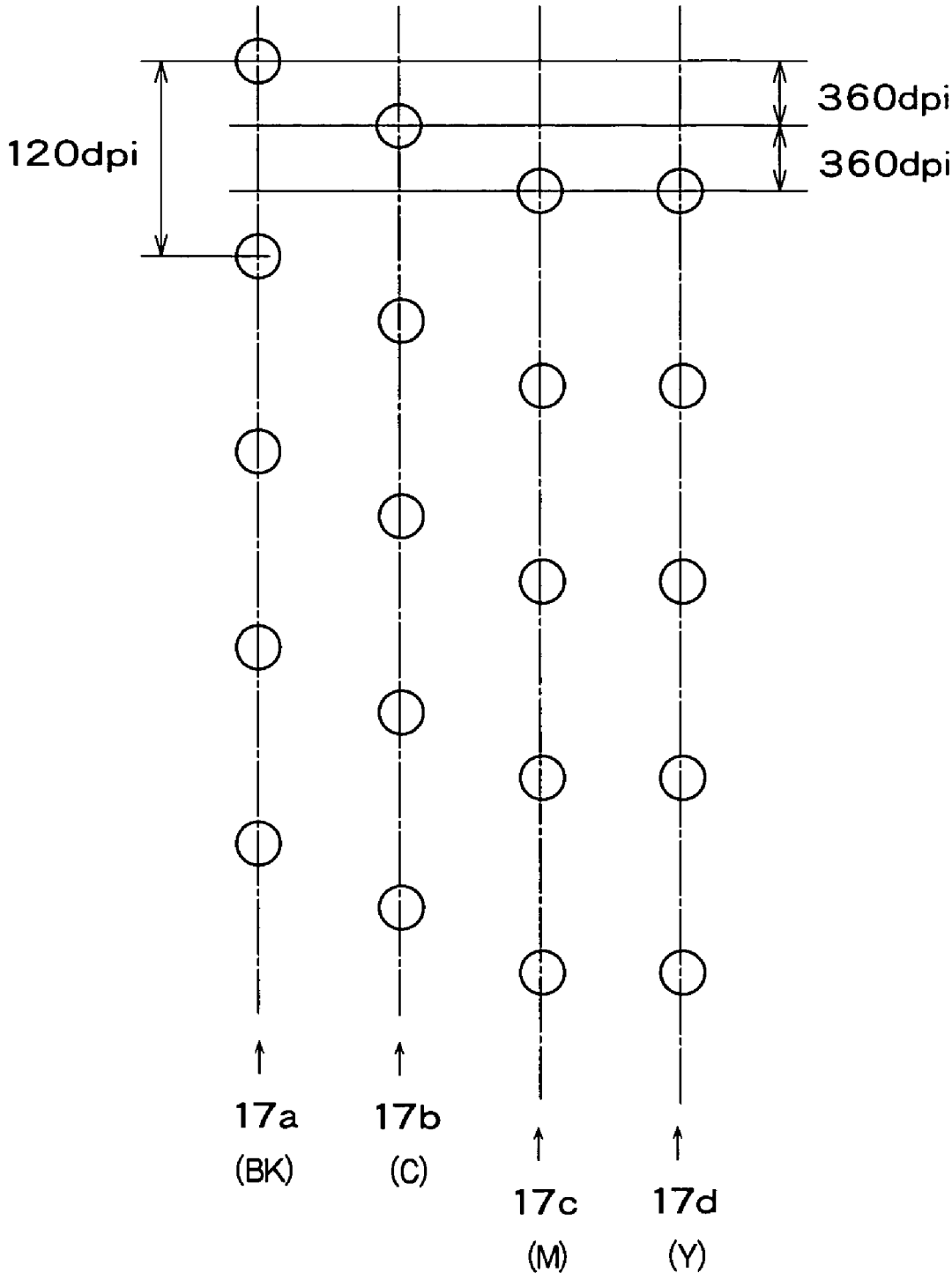
FIG. 3 is a plan view showing rows of nozzles for respective colors.

The recording head 4 of the present embodiment has: a black head unit capable of ejecting a drop of black ink, a cyan head unit capable of ejecting a drop of cyan ink, a magenta head unit capable of ejecting a drop of magenta ink, and a yellow head unit capable of ejecting a drop of yellow ink. The respective head units are communicated to respective ink chambers in the ink cartridges 2*a* and 2*b*. Each head unit has a structure as explained above with reference to FIG. 2. As shown in FIG. 3, a plurality of rows of nozzles are formed by the nozzles 17, each row of nozzles corresponding to each color (BK, C, M and Y).

In the example of FIG. 3, four rows of nozzles 17*a* to 17*d* are arranged in parallel with the sub scanning direction, each row of nozzles having 90 nozzles. A black ink is adapted to be supplied to the first row of nozzles 17*a*, a cyan ink is adapted to be supplied to the second row of nozzles 17*b*, a magenta ink is adapted to be supplied to the third row of nozzles 17*c*, and a yellow ink is adapted to be supplied to the fourth row of nozzles. The arrangement pitch of nozzles in each row of nozzles 17*a* to 17*d* is 120 dpi in common.

Positions of the second row of nozzles 17*b* (cyan) are shifted in the sub scanning direction by ⅓ of the arrangement pitch of nozzles (corresponding to 360 dpi), with respect to positions of the first row of nozzles 17*a* (black).

Then, positions of the third row of nozzles 17*c* (magenta) and the fourth row of nozzles 17*d* (yellow) are shifted in the sub scanning direction by ⅔ of the arrangement pitch of nozzles (corresponding to 360 dpi×2), with respect to the positions of the first row of nozzles 17*a* (black).

In the example of FIG. 3, the black ink, the cyan ink, the magenta ink and the yellow ink are arranged in that order. However, this arrangement relationship may be changed depending on ink characteristics.

Figure 4:
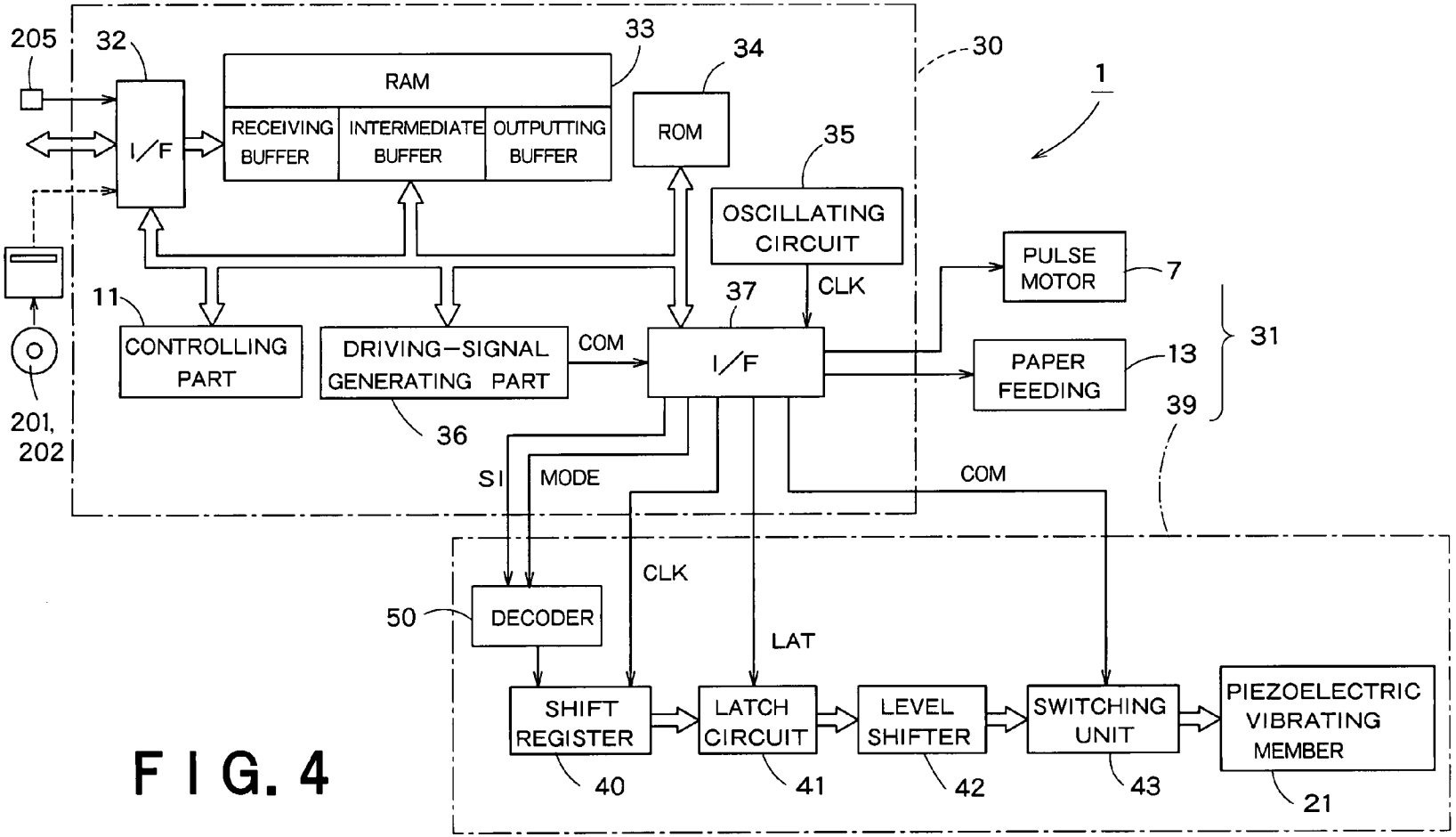
FIG. 4 is a schematic block diagram showing an electric structure of the recording head.

Then, an electric structure of the printer 1 is explained. As shown in FIG. 4, the ink-jetting printer 1 has a printer controller 30 and a printing engine 31.

The printer controller 30 has: an outside interface (outside I/F) 32, a RAM 33 which is able to temporarily store various data, a ROM 34 which stores a controlling program or the like, a controlling part 11 including CPU or the like, an oscillating circuit 35 for generating a clock signal, an driving-signal generating circuit 36 for generating an driving signal that is supplied to the recording head 4, and an inside interface (inside I/F) 37 that is adapted to send the driving signal, dot-pattern-data (bit-map-data) developed according to printing data, or the like to the print engine 31.

The outside I/F 32 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 32.

The RAM 33 has a receiving buffer, an intermediate buffer, an outputting buffer and a work memory not shown.

The receiving buffer is adapted to receive the printing data through the outside I/F 32, and temporarily store the printing data. The intermediate buffer is adapted to store intermediate-code-data converted from the printing data by the controlling part 11. The outputting buffer is adapted to store dot-pattern-data which are data for printing obtained by decoding (translating) the intermediate-code-data (for example, level data).

The ROM 34 stores font data, graphic functions or the like in addition to the controlling program (controlling routine) for carrying out various data-processing operations. The ROM 34 also stores various setting data for maintenance operations.

The controlling part 11 is adapted to carry out various controlling operations according to the controlling program stored in the ROM 34. For example, the controlling part 11 reads out the printing data from the receiving buffer, converts the printing data into the intermediate-code-data, causes the intermediate buffer to store the intermediate-code-data. Then, the controlling part 11 analyzes the intermediate-code-data in the intermediate buffer and develops (decodes) the intermediate-code-data into the dot-pattern-data with reference to the font data and the graphic functions or the like stored in the ROM 34. Then, the controlling part 11 carries out necessary decorating operations to the dot-pattern-data, and thereafter causes the outputting buffer to store the dot-pattern-data.

When the dot-pattern-data corresponding to one line recorded by one main scanning of the recording head 4 are obtained, the dot-pattern-data are outputted to an electric driving system 39 of the recording head 4 from the outputting buffer through the inside I/F 37. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 11 controls a maintenance operation (a recovering operation) conducted before the recording operation by the recording head 4.

The print engine 31 includes a paper feeding motor 13 as a paper feeding mechanism, a pulse motor 7 as a head scanning mechanism, and an electric driving system 39 of the recording head 4.

Then, the electric driving system 39 of the recording head 4 is explained. As shown in FIG. 4, the electric driving system 39 includes decoders 50, shift registers 40, latch circuits 41, level shifters 42 and switching units 43 and the piezoelectric vibrating members 21, which are electrically connected in the order. The decoders 50 correspond to the respective nozzles 17 of the recording head 4, respectively. Similarly, the shift registers 40 correspond to the respective nozzles 17, the latch circuits 41 correspond to the respective nozzles 17, the level shifters 42 correspond to the respective nozzles 17, and the switching units 43 correspond to the respective nozzles 17, respectively. In addition, the piezoelectric vibrating members 21 also correspond to the respective nozzles 17 of the recording head 4, respectively.

In the electric driving system 39, when a pulse-selecting datum (SP datum) supplied to a switching unit 43 is "1", the switching unit 43 is closed (connected) and a pulse-wave in the driving signal is directly supplied to a corresponding piezoelectric vibrating member 21. Thus, the piezoelectric vibrating member 21 deforms according to the pulse-wave of the driving signal. On the other hand, when a pulse-selecting datum (SP datum) supplied to a switching unit 43 is "0", the switching unit 43 is opened (unconnected) and the driving signal is not supplied to a corresponding piezoelectric vibrating member 21.

As described above, based on the pulse-selecting data, the driving signal may be selectively supplied to each piezoelectric vibrating member 21. Thus, dependently on given pulse-selecting data, a drop of the ink may be ejected from a nozzle 17 or a meniscus of ink may be caused to minutely vibrate.

In addition, a mode-selecting (mode-switching) part 205, which selects one from a normal mode and a high-speed black mode, is connected to the outside I/F 32. As a mode-selecting part 205, a keyboard of the host computer, various switches, other suitable interfaces may be used.

Figure 5:
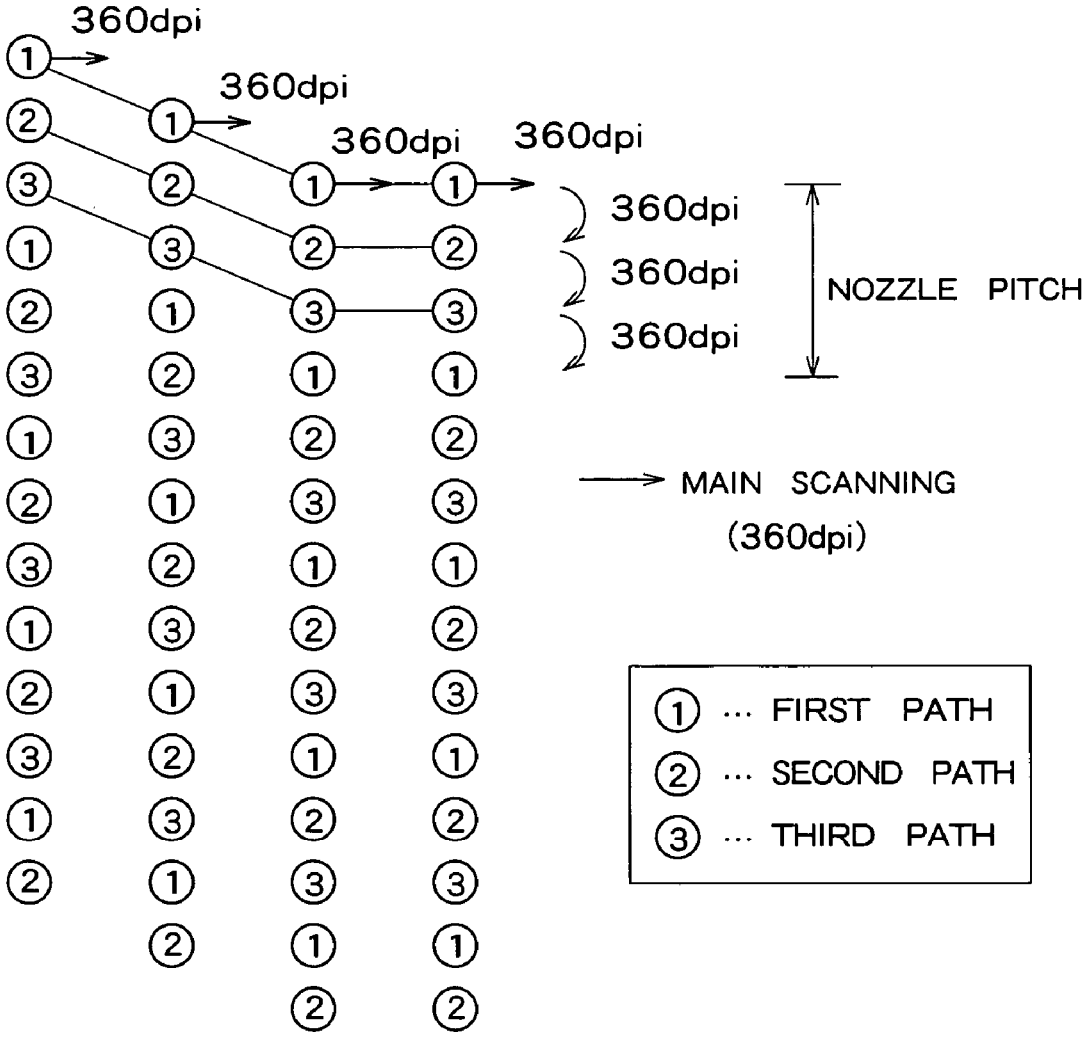
FIG. 5 is a schematic view for explaining a path control in a normal mode.

In the normal mode of the present embodiment, 360×360 dpi is obtained. Thus, as shown in FIG. 5, per one nozzle pitch (corresponding to 120 dpi), a three-path main scanning operation is carried out.

In the normal mode, by a control of the controlling part 11, the black ink is ejected from each nozzle of the first row of nozzles 17*a* onto the recording paper 12 based on recording data for each nozzle of the first row of nozzles 17*a*, the cyan ink is ejected from each nozzle of the second row of nozzles 17*b* onto the recording paper 12 based on recording data for each nozzle of the second row of nozzles 17*b*, the magenta ink is ejected from each nozzle of the third row of nozzles 17*c* onto the recording paper 12 based on recording data for each nozzle of the third row of nozzles 17*c*, and the yellow ink is ejected from each nozzle of the fourth row of nozzles 17*d* onto the recording paper 12 based on recording data for each nozzle of the fourth row of nozzles 17*d*.

On the other hand, in the high-speed black mode, per one nozzle pitch, a one-path main scanning operation is carried out. However, in the high-speed black mode of the present embodiment, in connection with ejection of the black ink, the respective color inks are ejected so that 360×360 dpi is semblably achieved.

Figure 6:
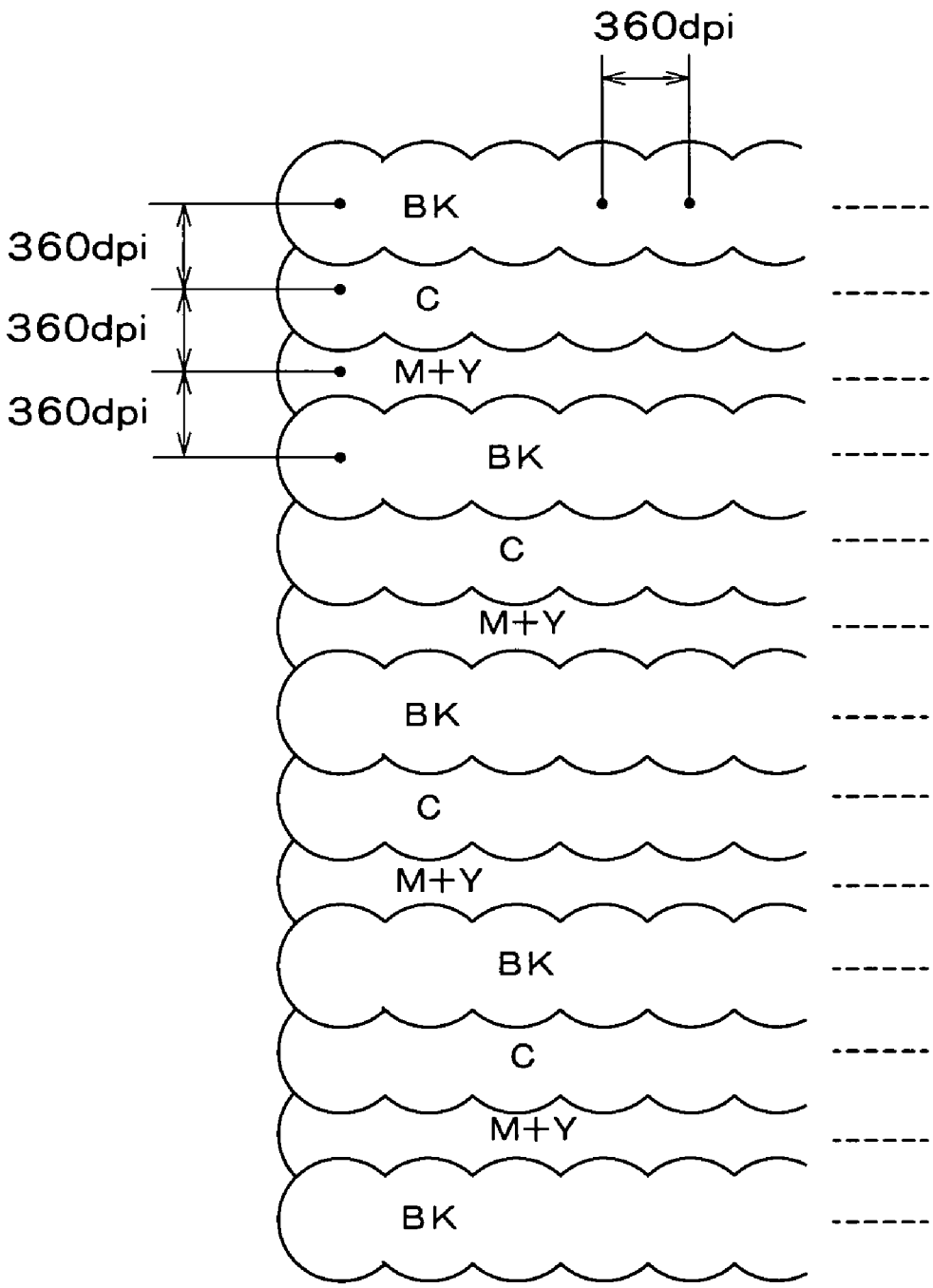
FIG. 6 is a schematic view for explaining an ink-ejecting state in a high-speed black mode.

That is, in the high-speed black mode of the present embodiment, as shown in FIG. 6, by a control of the controlling part 11, the black ink is ejected from each nozzle of the first row of nozzles 17*a* onto the recording paper 12 based on recording data for each nozzle of the first row of nozzles 17*a*, and the respective color inks are ejected from each corresponding nozzle of the second row of nozzles 17*b*, each corresponding nozzle of the third row of nozzles 17*c* and each corresponding nozzle of the fourth row of nozzles 17*d* onto the recording paper 12 based on the same recording data.

Figure 7:
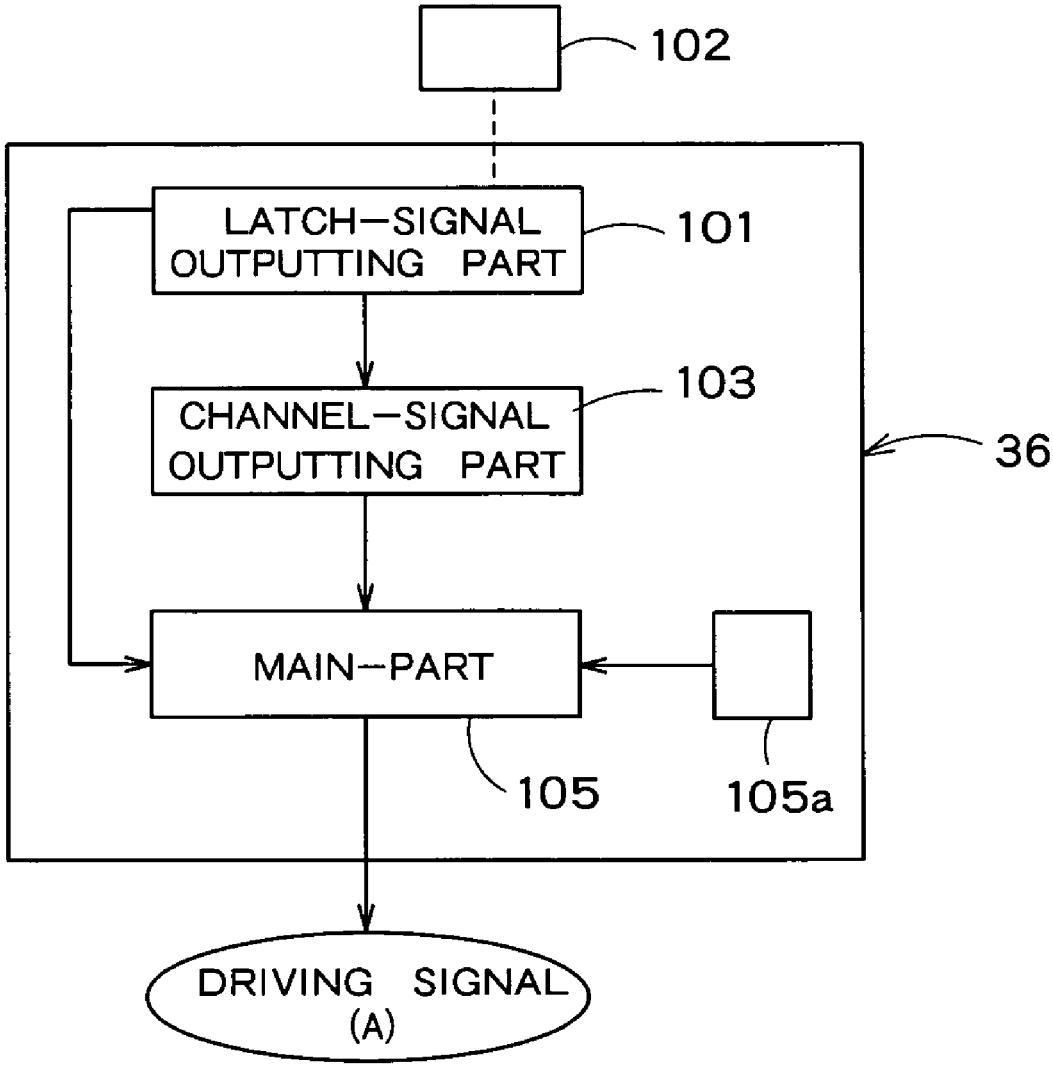
FIG. 7 is a schematic block diagram showing a driving-signal generating circuit.

Herein, the driving-signal generating circuit 36 is explained in detail with reference to FIG. 7. As shown in FIG. 7, the driving-signal generating circuit 36 has a latch-signal outputting part 101 that outputs a plurality of latch signals synchronizing with passage timings of predetermined passage positions of the recording head 4. The latch-signal outputting part 101 is connected to an encoder 102 that detects a position or a moving amount of the recording head 4, in order to synchronize with the passage timings of the respective passage positions (set for respective pixels) of the recording head 4.

In addition, the driving-signal generating circuit 36 has a channel-signal outputting part 103, which outputs a channel signal after a set time difference subsequent to each latch signal, based on the predetermined time difference against the latch signal.

Then, the latch-signal outputting part 101 and the channel-signal outputting part 103 are connected to a main part 105.

Figure 8:
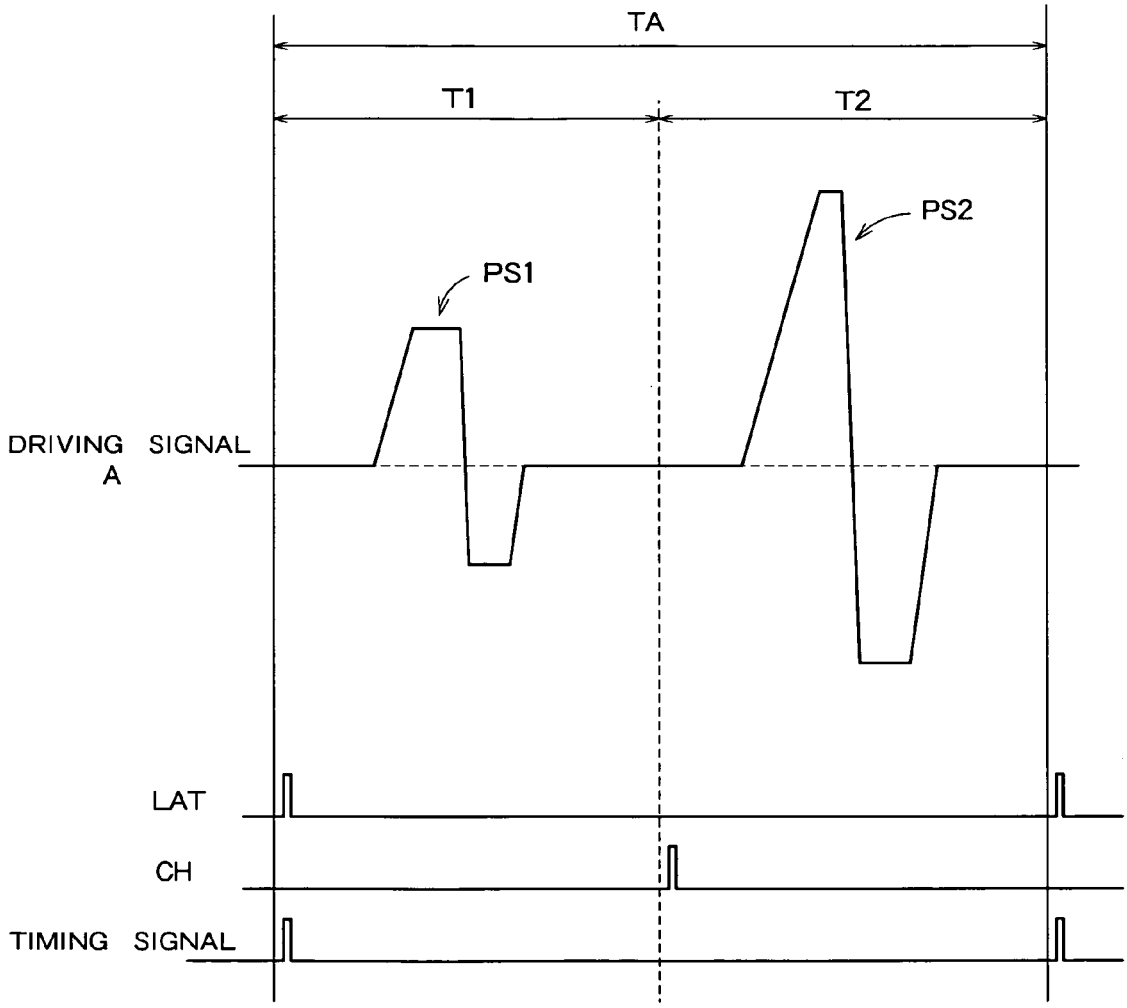
FIG. 8 is a diagram of an example of a driving signal.

The main-part 105 is adapted to generate a driving signal (A: see FIG. 8) having: a latch pulse-wave (in the case, a first pulse signal PS1) appearing at an outputting timing of each latch signal, and a channel pulse-wave (in the case, a second pulse signal PS2) appearing at an outputting timing of each channel signal by the channel-signal outputting part 103, in that order.

Originally, the high-speed black mode is a recording mode by only a black color, as shown by its own name. However, in the present embodiment, the respective color inks are also ejected to the recording paper 12. Thus, the color tone is not complete black. Thus, in order to improve visibility of recorded objects by a user, it is preferable that volumes of the color inks ejected from the nozzles are adjusted. In the present embodiment, in order to achieve such an ink-volume adjustment, a high-speed-black-mode color-tone amending part 105*a* is connected to the main part 105.

For example, in the high-speed black mode, the high-speed-black-mode color-tone amending part 105*a* increases or decreases an amplitude of the driving signal generated by the main part 105 for each of the rows of nozzles in such a manner that a relative proportion of volume of each ejected color ink coincides with a predetermined proportion.

Specifically, in the high-speed black mode, when the volume of an ejected black ink is 100%, the volume of an ejected cyan ink may be adjusted to 100%, the volume of an ejected magenta ink may be adjusted to 70 to 85%, and the volume of an ejected yellow ink may be adjusted to 70 to 85%. For example, for a 256 gradation, when the black ink and the cyan ink are set at 255 (MAX), the magenta ink and the yellow ink may be adjusted at 200 (about 78%). In the case, reddishness is inhibited, so that superior printing quality in beauty can be achieved.

In the above description, the volume of each color ink ejected in the high-speed black mode is adjusted by increasing and/or decreasing the amplitude of the driving signal for each of the rows of nozzles. However, the method of adjusting the ejected volume of each color ink is not limited thereto. For example, another method may be adopted, wherein the number of ejection of ink drops per unit pixel may be changed by using an "LUT", as disclosed in JP Laid-Open Publication No. Hei11-314382. Specifically, in the high-speed black mode, among 100×100=10000 pixels, the numbers of ejection of ink drops may be adjusted (lopped) in such a manner that the black ink is limited to 1000 pixels, the magenta ink and the yellow ink are limited to 700 to 850 pixels, and the cyan ink is limited to 1000 pixels.

According to the printer 1 of the present embodiment as described above, although the positions of the rows of nozzles are different in the sub scanning direction between the rows of nozzles, the same recording quality as conventional printers can be obtained in the normal mode.

Then, in the high-speed black mode, although the color tone is not complete black, no gap line may be perceived, so that a beautiful, high-quality recording operation can be achieved.

In particular, demerits that the color tone is not complete black can be substantially cleared by the adjustment by the high-speed-black-mode color-tone amending part 105*a*.

Figure 9:
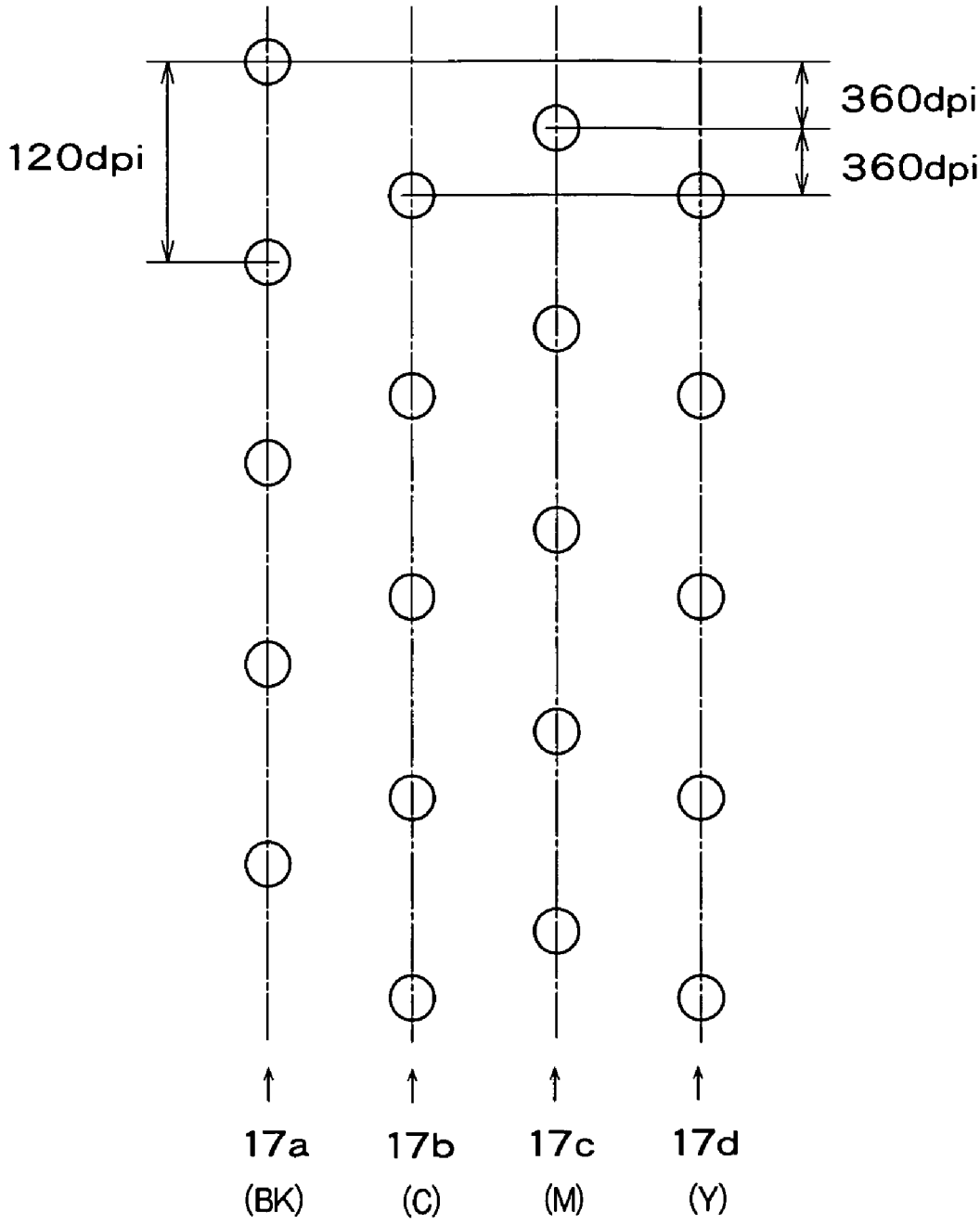
FIG. 9 is a plan view showing another arrangement of rows of nozzles.

In addition, instead of the nozzle arrangement of FIG. 3, a nozzle arrangement as shown in FIG. 9 may be adopted. In the example of FIG. 9 as well, four rows of nozzles 17*a* to 17*d* are arranged in parallel with the sub scanning direction, each row of nozzles having 90 nozzles. A black ink is adapted to be supplied to the first row of nozzles 17*a*, a cyan ink is adapted to be supplied to the second row of nozzles 17*b*, a magenta ink is adapted to be supplied to the third row of nozzles 17*c*, and a yellow ink is adapted to be supplied to the fourth row of nozzles. The arrangement pitch of nozzles in each row of nozzles 17*a* to 17*d* corresponds to 120 dpi in common.

Differently from the case of FIG. 3, positions of the second row of nozzles 17*b* (cyan) are shifted in the sub scanning direction by ⅔ of the arrangement pitch of nozzles (corresponding to 360 dpi×2), with respect to positions of the first row of nozzles 17*a* (black). In addition, positions of the third row of nozzles 17*c* (magenta) are shifted in the sub scanning direction by ⅓ of the arrangement pitch of nozzles (corresponding to 360 dpi), with respect to the positions of the first row of nozzles 17*a* (black).

Positions of the fourth row of nozzles 17*d* (yellow) are shifted in the sub scanning direction by ⅔ of the arrangement pitch of nozzles (corresponding to 360 dpi×2), with respect to positions of the first row of nozzles 17*a* (black).

Figure 10:
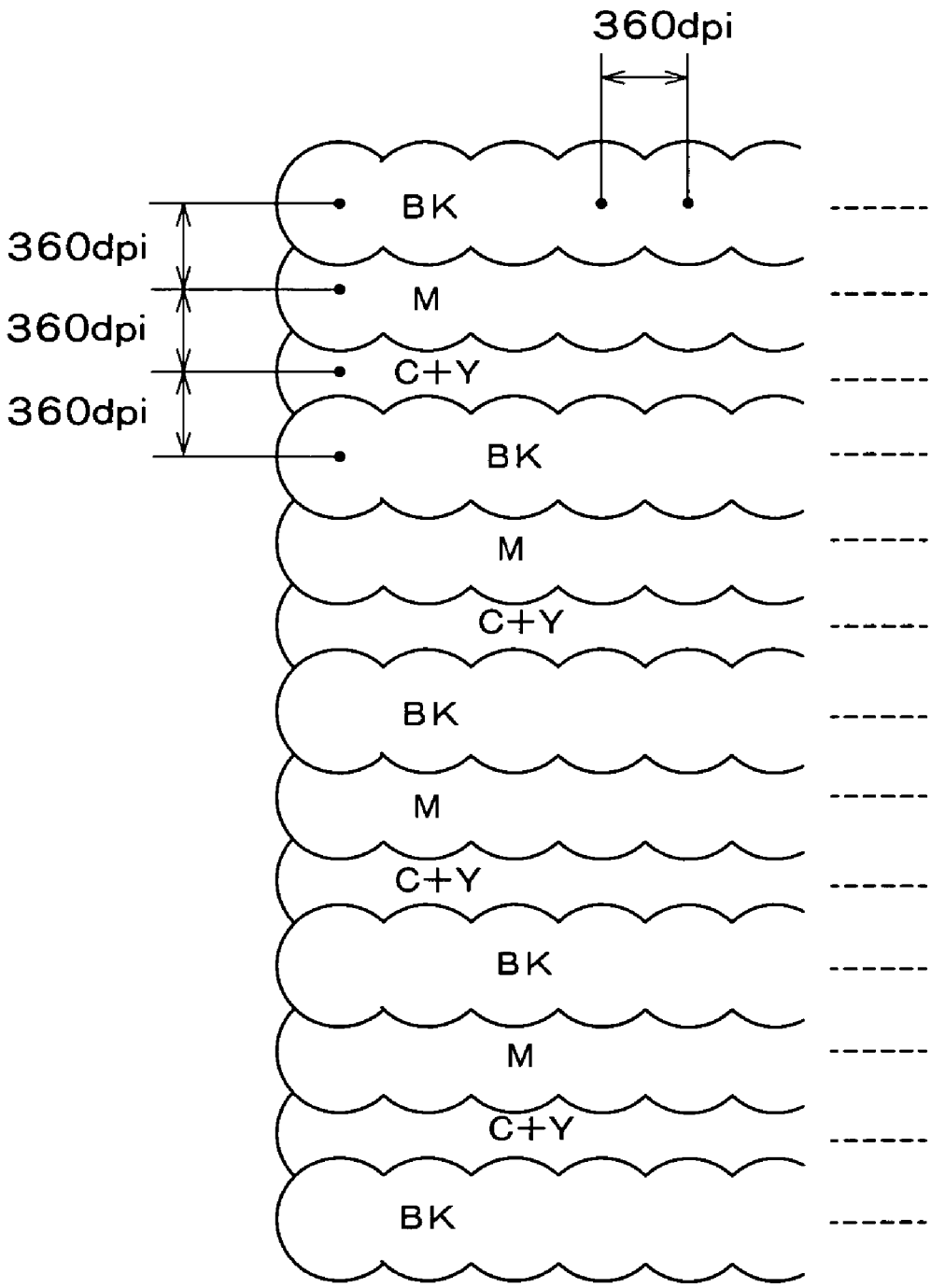
FIG. 10 is a schematic view for explaining an ink-ejecting state in a high-speed black mode according to the arrangement of rows of nozzles of FIG. 9.

In the nozzle arrangement of FIG. 3, in the high-speed black mode, dots of the black ink, dots of the cyan ink, and mixed dots (red dots) of the magenta ink and the yellow ink are formed on the recording paper 12. On the other hand, in the nozzle arrangement of FIG. 9, in the high-speed black mode, as shown in FIG. 10, dots of the black ink, dots of the magenta ink, and mixed dots of the cyan ink and the yellow ink are formed on the recording paper 12. In the latter manner as well, visibility thereof is not so inferior.

In the nozzle arrangement of FIG. 9, in the high-speed black mode, when the volume of an ejected black ink is 100%, the volume of an ejected cyan ink may be adjusted to 70 to 85%, the volume of an ejected magenta ink may be adjusted to 100%, and the volume of an ejected yellow ink may be adjusted to 70 to 85%. For example, for a 256 gradation, when the black ink and the magenta ink are set at 255 (MAX), the cyan ink and the yellow ink may be adjusted at 200 (about 78%). In the case, greenishness is inhibited, so that superior printing quality in beauty can be achieved.

Figure 11:
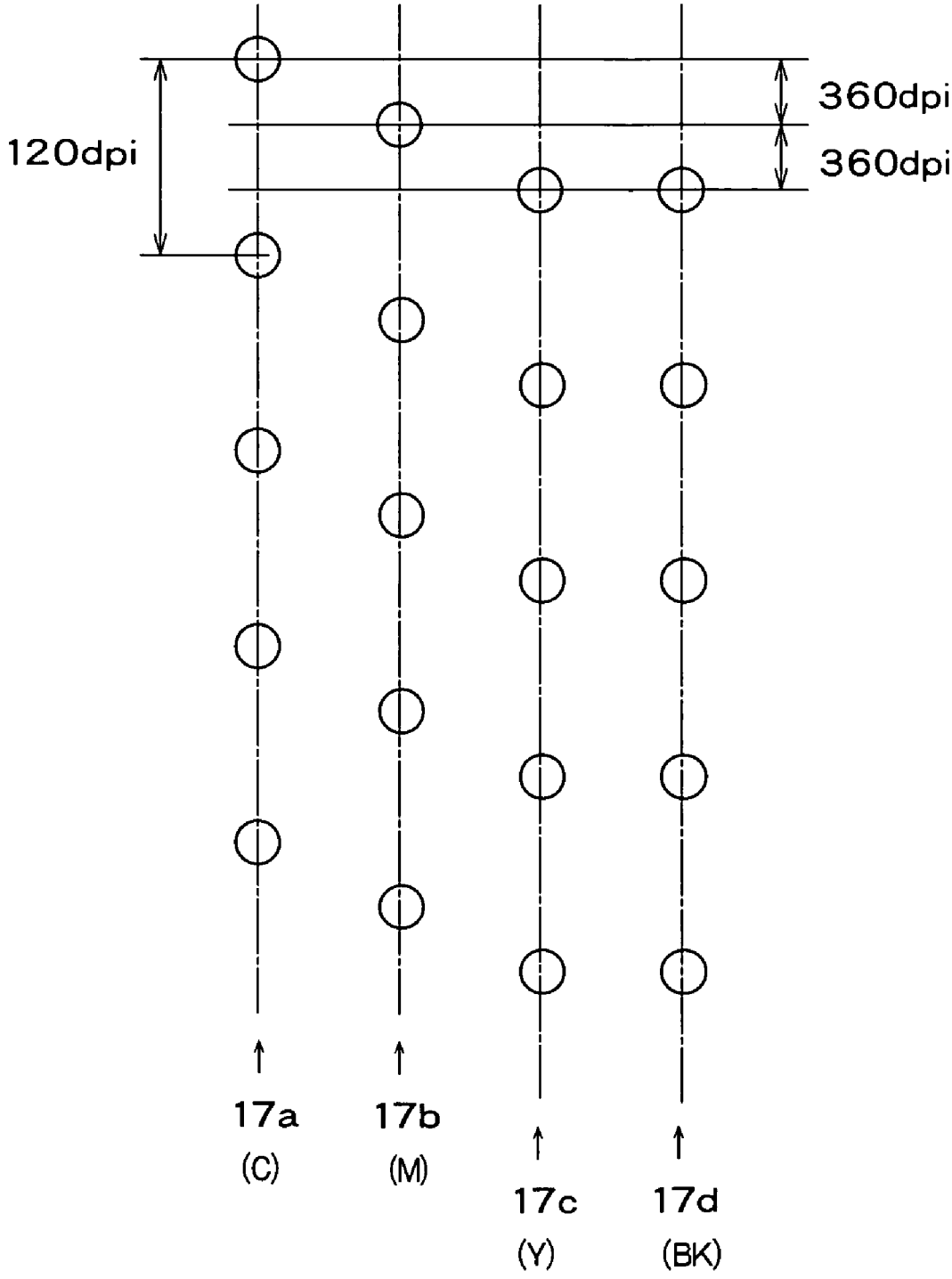
FIG. 11 is a plan view showing another arrangement of rows of nozzles.

In addition, a nozzle arrangement as shown in FIG. 11 may be also adopted. In the example of FIG. 11 as well, four rows of nozzles 17*a* to 17*d* are arranged in parallel with the sub scanning direction, each row of nozzles having 90 nozzles. However, differently from the cases of FIGS. 3 and 9, a cyan ink is adapted to be supplied to the first row of nozzles 17*a*, a magenta ink is adapted to be supplied to the second row of nozzles 17*b*, a yellow ink is adapted to be supplied to the third row of nozzles 17*c*, and a black ink is adapted to be supplied to the fourth row of nozzles. The arrangement pitch of nozzles in each row of nozzles 17*a* to 17*d* corresponds to 120 dpi in common.

Positions of the second row of nozzles 17*b* (magenta) are shifted in the sub scanning direction by ⅓ of the arrangement pitch of nozzles (corresponding to 360 dpi), with respect to positions of the first row of nozzles 17*a* (cyan).

Then, positions of the third row of nozzles 17*c* (yellow) and the fourth row of nozzles 17*d* (black) are shifted in the sub scanning direction by ⅔ of the arrangement pitch of nozzles (corresponding to 360 dpi×2), with respect to the positions of the first row of nozzles 17*a* (cyan).

Figure 12:
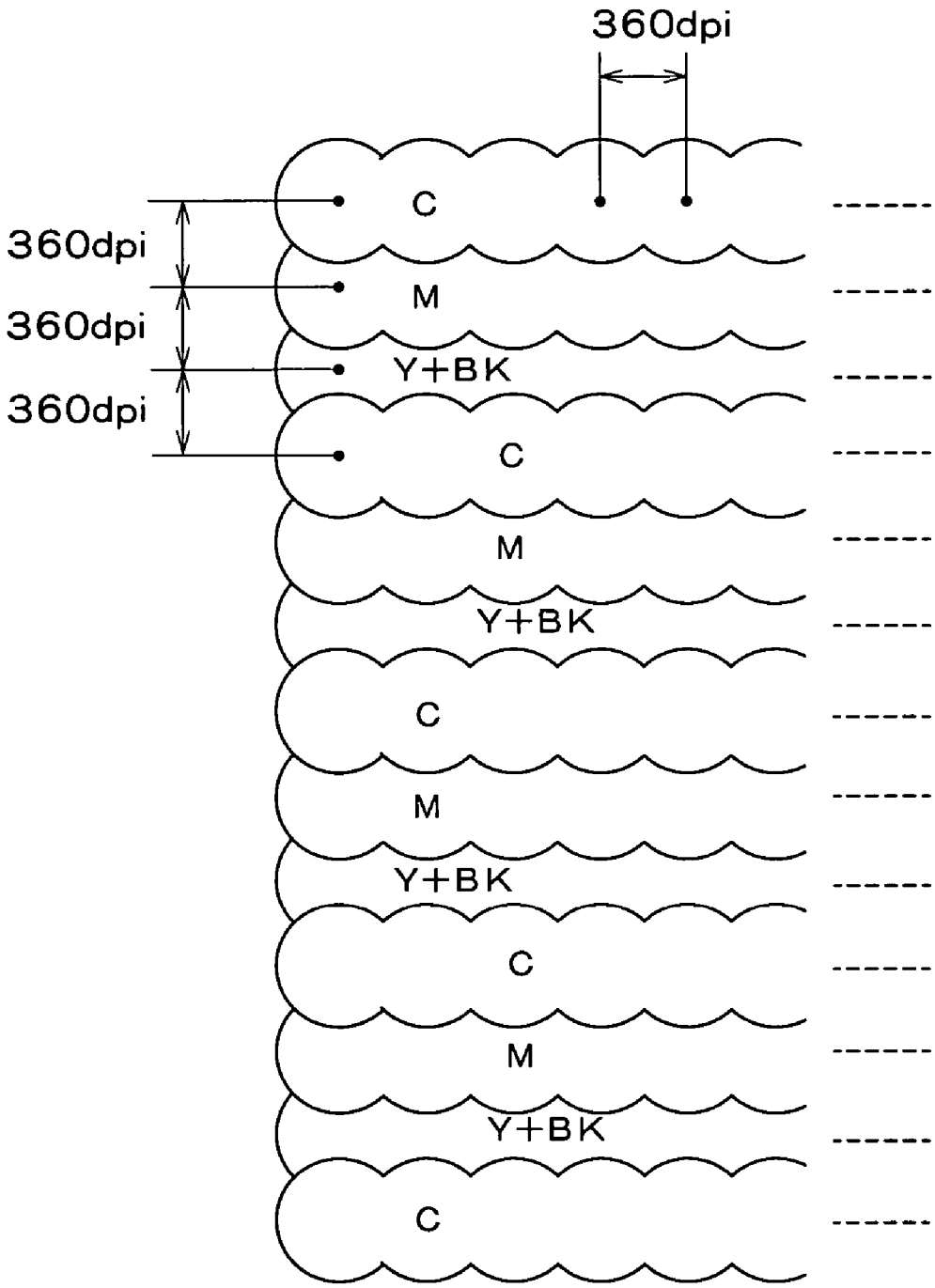
FIG. 12 is a schematic view for explaining an ink-ejecting state in a high-speed black mode according to the arrangement of rows of nozzles of FIG. 11.
Figure 13:
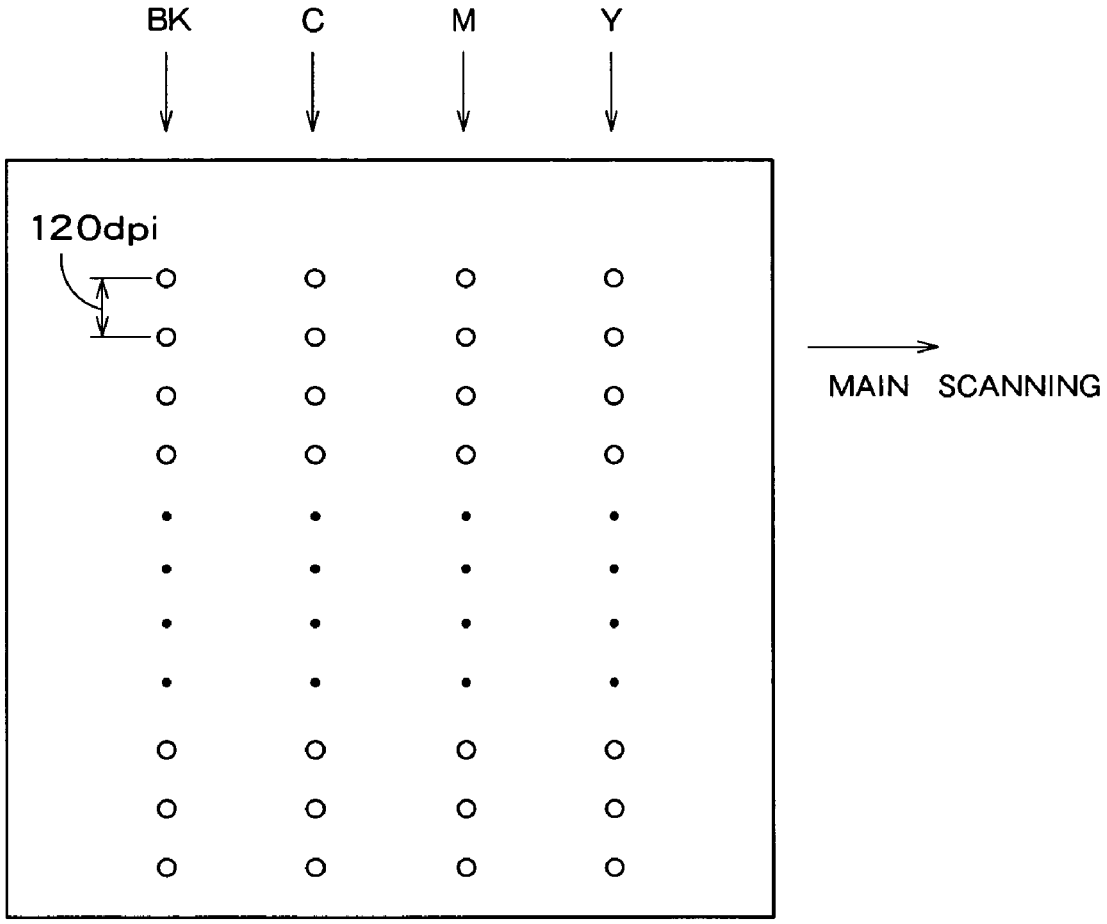
FIG. 13 is a plan view showing a conventional arrangement of rows of nozzles.
Figure 14:
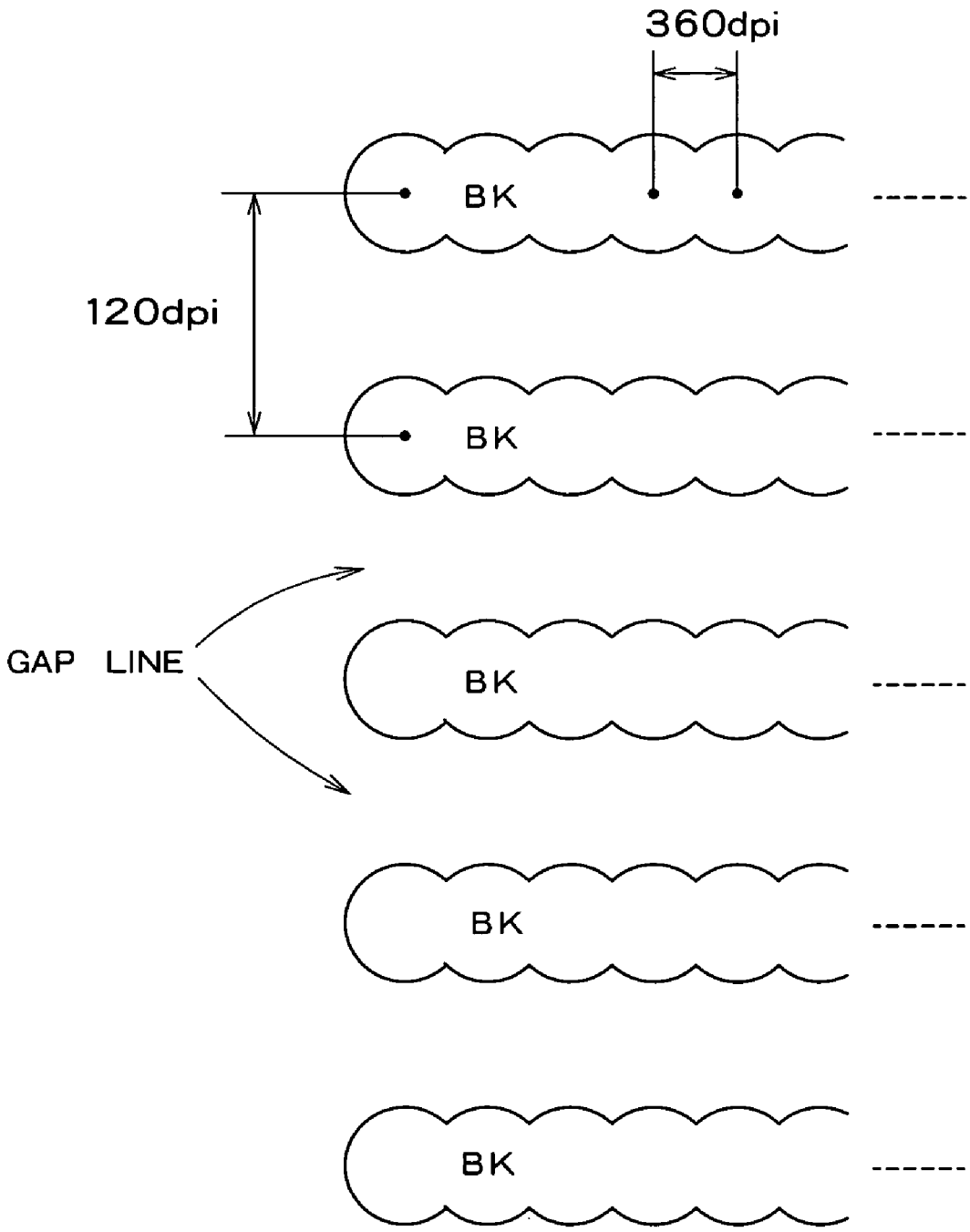
FIG. 14 is a schematic view for explaining gap lines generated in a conventional high-speed black mode.

In the nozzle arrangement of FIG. 11, in the high-speed black mode, as shown in FIG. 12, dots of the cyan ink, dots of the magenta ink, and mixed dots of the yellow ink and the black ink are formed on the recording paper 12. In this manner as well, visibility thereof is not so inferior.

In the nozzle arrangement of FIG. 11, in the high-speed black mode, when the volume of an ejected black ink is 100%, the volume of an ejected cyan ink may be adjusted to 100%, the volume of an ejected magenta ink may be adjusted to 100%, and the volume of an ejected yellow ink may be adjusted to 70 to 85%. For example, for a 256 gradation, when the black ink, the cyan ink and the magenta ink are set at 255 (MAX), the yellow ink may be adjusted at 200 (about 78%). In the case, superior printing quality in beauty can be achieved.

Herein, there is no merit in adopting dots of only the yellow ink, because the color tone is weak (thin) compared with the other dots.

In addition, it is possible to obtain the same effect in a six-color printer including a light cyan ink and a light magenta ink additionally to the above four colors of the black ink, the cyan ink, the magenta ink and the yellow ink, and in a seven-color printer or an eight-color printer further including a dark yellow ink and/or a photo black ink, depending on combination of rows of nozzles and colors of supplied inks.

A so-called longitudinal vibration mode of piezoelectric vibrating member may be used, instead of the distortion vibration mode of piezoelectric vibrating member 21. In a case using the longitudinal vibration mode of piezoelectric vibrating member, the corresponding pressure chamber can expand by deformation of the piezoelectric vibrating member when the piezoelectric vibrating member is charged, and can contract by deformation of the piezoelectric vibrating member when the piezoelectric vibrating member is discharged. When a longitudinal vibration mode of piezoelectric vibrating member is used, relationship of rising and falling the driving signal is opposite (positive and negative are in reverse), compared with a case wherein the distortion vibration mode of piezoelectric vibrating member 21 is used.

In addition, a pressure-generating member (an example of pressure-changing unit) for changing the volume of the pressure chamber 22 is not limited to the piezoelectric vibrating member. For example, a pressure-generating member can consist of a magnetostrictive device. In the case, the magnetostrictive device causes the pressure chamber 22 to expand and contract, thus, changes the pressure of the ink in the pressure chamber 22. Alternatively, a pressure-generating member can consist of a heating device. In the case, the heating device causes an air bubble in the pressure chamber 22 to expand and contract, thus, changes the pressure of the ink in the pressure chamber 22. In the case, in order to adjust the volume of an ejected ink drop, it is more preferable to change a pulse width of the driving signal.

In addition, as described above, the printer controller 30 can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk (flexible disk) or the like, but also a network for transmitting various signals.

The above description is given for an ink-jetting recording apparatus. However, this invention is intended to apply to general liquid ejecting apparatuses widely. A liquid may be glue, nail polish, liquid metal for forming an electric circuit, organic liquid or the like, instead of the ink. In addition, this invention can be also applied to an apparatus for manufacturing color filters of a display member such as a liquid crystal display.

What is claimed is:

1. A liquid ejecting apparatus comprising a head member having a plurality of nozzles, a plurality of liquid ejecting units, each of which ejects a liquid in each of the plurality of nozzles, a main scanning unit that causes the head member to move in a main scanning direction relatively to a medium to which the liquid is ejected, a sub scanning unit that causes the medium to move in a sub scanning direction relatively to the head member, the sub scanning direction being perpendicular to the main scanning direction, a driving-signal outputting unit that outputs a driving signal for each of the plurality of liquid ejecting units, a main controller that controls the main scanning unit, the sub scanning unit and the driving-signal outputting unit in order to eject the liquid from each of the plurality of nozzles to a predetermined position on the medium based on effecting data, and a mode-selecting part that selects one from a normal mode and a high-speed black mode, wherein the plurality of nozzles forms n rows of nozzles extending in parallel with the sub scanning direction, n being three or more, a black liquid is adapted to be supplied to one row of nozzles among the n rows of nozzles, color liquids are adapted to be supplied to the other rows of nozzles among the n rows of nozzles, the color liquids being different for each of the other rows of nozzles, an arrangement pitch of nozzles is the same for each of the rows of nozzles, positions of m rows of nozzles among the n rows of nozzles are shifted in the sub scanning direction by every 1/m of the arrangement pitch of nozzles for each of the m rows of nozzles, m being not less than three and not more than n, when the normal mode is selected by the mode-selecting part, the main controller controls the main scanning unit and the sub scanning unit: so as to cause the medium to move in the sub scanning direction relatively to the head member by 1/m of the arrangement pitch of nozzles, after each of first to (m−1)-th movements in the scanning direction of the head member relatively to the medium; and to cause the medium to move in the sub scanning direction relatively to the head member by a difference between a nozzle-row pitch in the sub scanning direction and (m−1)/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles, when the high-speed black mode is selected by the mode-selecting part, the main controller controls the main scanning unit and the sub scanning unit: so as to cause the medium to move in the sub scanning direction relatively to the head member by the nozzle-row pitch in the sub scanning direction, after each movement in the scanning direction of the head member relatively to the medium, when the normal mode is selected by the mode-selecting part, the main controller serves to eject each liquid from each nozzle of each row of nozzles toward the medium, based on ejecting data for each nozzle of each row of nozzles, during each movement in the scanning direction of the head member relatively to the medium, and when the high-speed black mode is selected by the mode-selecting part, the main controller serves to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

2. A liquid ejecting apparatus according to claim 1, wherein:

the head member is a recording head, the plurality of liquid ejecting units is a plurality of pressure-changing units, each of which changes a pressure of ink in each of the plurality of nozzles so as to eject the ink, the medium to which the liquid is ejected is a recording medium, the ejecting data are recording data, the main scanning unit is adapted to cause the recording head to move in the main scanning direction relatively to the recording medium, the sub scanning unit is adapted to cause the recording medium to move in the sub scanning direction relatively to the recording head, the sub scanning direction being perpendicular to the main scanning direction, the driving-signal outputting unit is adapted to output a driving signal for each of the plurality of pressure-changing units, and the main controller is adapted to control the main scanning unit, the sub scanning unit and the driving-signal outputting unit in order to eject the ink from each of the plurality of nozzles to a predetermined position on the recording medium, based on the recording data.

3. A liquid ejecting apparatus according to claim 2, wherein:

the n rows of nozzles are four rows of nozzles, the m rows of nozzles are three rows of nozzles, the plurality of nozzles forms a first row of nozzles, a second row of nozzles, a third row of nozzles and a fourth row of nozzles, which extend in parallel with the sub scanning direction, a black ink is adapted to be supplied to one row of nozzles among the first row of nozzles to the fourth row of nozzles, color inks are adapted to be supplied to the other rows of nozzles among the first row of nozzles to the fourth row of nozzles, the color inks being different for each of the other rows of nozzles, positions of one row of nozzles among the second and third rows of nozzles are shifted in the sub scanning direction by ⅓ of the arrangement pitch of nozzles with respect to positions of the first row of nozzles, positions of the other row of nozzles among the second and third rows of nozzles are shifted in the sub scanning direction by ⅔ of the arrangement pitch of nozzles with respect to the positions of the first row of nozzles, positions of the fourth row of nozzles are shifted in the sub scanning direction by ⅓ or ⅔ of the arrangement pitch of nozzles with respect to the positions of the first row of nozzles, when the normal mode is selected by the mode-selecting part, the main controller controls the main scanning unit and the sub scanning unit: so as to cause the recording medium to move in the sub scanning direction relatively to the recording head by ⅓ of the arrangement pitch of nozzles, after a first movement in the scanning direction of the recording head relatively to the recording medium; to cause the recording medium to move in the sub scanning direction relatively to the recording head by ⅓ of the arrangement pitch of nozzles, after the next one movement in the scanning direction of the recording head relatively to the recording medium as well; and to cause the recording medium to move in the sub scanning direction relatively to the recording head by a difference between a nozzle-row pitch in the sub scanning direction and ⅔ of the arrangement pitch of nozzles, after the next one movement in the scanning direction of the recording head relatively to the recording medium, the nozzle-row pitch corresponding to a product of the number of nozzles in each row of nozzles and the arrangement pitch of nozzles, when the high-speed black mode is selected by the mode-selecting part, the main controller controls the main scanning unit and the sub scanning unit: so as to cause the recording medium to move in the sub scanning direction relatively to the recording head by the nozzle-row pitch in the sub scanning direction, after each movement in the scanning direction of the recording head relatively to the recording medium, when the normal mode is selected by the mode-selecting part, the main controller serves to eject the ink from each nozzle of the first row of nozzles toward the medium based on recording data for each nozzle of the first row of nozzles, to eject the ink from each nozzle of the second row of nozzles toward the medium based on recording data for each nozzle of the second row of nozzles, to eject the ink from each nozzle of the third row of nozzles toward the medium based on recording data for each nozzle of the third row of nozzles, and to eject the ink from each nozzle of the fourth row of nozzles toward the medium based on recording data for each nozzle of the fourth row of nozzles, during each movement in the scanning direction of the recording head relatively to the recording medium, and when the high-speed black mode is selected by the mode-selecting part, the main controller serves to eject the black ink from each nozzle of the row of nozzles to which the black ink is supplied, toward the medium, based on recording data for each nozzle of the row of nozzles, and to eject the respective color inks from each corresponding nozzle of the other rows of nozzles toward the medium, based on the recording data.

4. A liquid ejecting apparatus according to claim 3, wherein the arrangement pitch of nozzles is 120 dpi.

5. A liquid ejecting apparatus according to claim 3, wherein the pressure-changing unit includes a bending-mode piezoelectric vibrating member.

6. A liquid ejecting apparatus according to claim 3, wherein when the high-speed black mode is selected by the mode-selecting part, the main controller serves to eject each ink from each nozzle of each row of nozzles in such a manner that a relative proportion of volume of the ejected ink coincides with a predetermined proportion.

7. A liquid ejecting apparatus according to claim 3, wherein the first row of nozzles, the second row of nozzles, the third row of nozzles and the fourth row of nozzles are alongside arranged in that order, a black ink is adapted to be supplied to the first row of nozzles, a cyan ink is adapted to be supplied to the second row of nozzles, a magenta ink is adapted to be supplied to the third row of nozzles, and a yellow ink is adapted to be supplied to the fourth row of nozzles.

8. A liquid ejecting apparatus according to claim 7, wherein positions of the second row of nozzles are shifted in the sub scanning direction by ⅓ of the arrangement pitch of nozzles with respect to the positions of the first row of nozzles, positions of the third row of nozzles are shifted in the sub scanning direction by ⅔ of the arrangement pitch of nozzles with respect to the positions of the first row of nozzles, and positions of the fourth row of nozzles are shifted in the sub scanning direction by ⅔ of the arrangement pitch of nozzles with respect to the positions of the first row of nozzles.

9. A liquid ejecting apparatus according to claim 8, wherein in the high-speed black mode, when the volume of an ejected black ink is 100%, the volume of an ejected cyan ink is 100%, the volume of an ejected magenta ink is 70 to 85%, and the volume of an ejected yellow ink is 70 to 85%.

10. A liquid ejecting apparatus according to claim 7, wherein positions of the second row of nozzles are shifted in the sub scanning direction by ⅔ of the arrangement pitch of nozzles with respect to the positions of the first row of nozzles, positions of the third row of nozzles are shifted in the sub scanning direction by ⅓ of the arrangement pitch of nozzles with respect to the positions of the first row of nozzles, and positions of the fourth row of nozzles are shifted in the sub scanning direction by ⅔ of the arrangement pitch of nozzles with respect to the positions of the first row of nozzles.

11. A liquid ejecting apparatus according to claim 10, wherein in the high-speed black mode, when the volume of an ejected black ink is 100%, the volume of an ejected cyan ink is 70 to 85%, the volume of an ejected magenta ink is 100%, and the volume of an ejected yellow ink is 70 to 85%.

12. A liquid ejecting apparatus according to claim 3, wherein the first row of nozzles, the second row of nozzles, the third row of nozzles and the fourth row of nozzles are alongside arranged in that order, a cyan ink is adapted to be supplied to the first row of nozzles, a magenta ink is adapted to be supplied to the second row of nozzles, a yellow ink is adapted to be supplied to the third row of nozzles, and a black ink is adapted to be supplied to the fourth row of nozzles.

13. A liquid ejecting apparatus according to claim 12, wherein positions of the second row of nozzles are shifted in the sub scanning direction by ⅓ of the arrangement pitch of nozzles with respect to the positions of the first row of nozzles, positions of the third row of nozzles are shifted in the sub scanning direction by ⅔ of the arrangement pitch of nozzles with respect to the positions of the first row of nozzles, and positions of the fourth row of nozzles are shifted in the sub scanning direction by ⅔ of the arrangement pitch of nozzles with respect to the positions of the first row of nozzles.

14. A liquid ejecting apparatus according to claim 13, wherein in the high-speed black mode, when the volume of an ejected black ink is 100%, the volume of an ejected cyan ink is 100%, the volume of an ejected magenta ink is 100%, and the volume of an ejected yellow ink is 70 to 85%.

15. A controlling unit for controlling a liquid ejecting apparatus including: a head member having a plurality of nozzles; a plurality of liquid ejecting units, each of which ejects a liquid in each of the plurality of nozzles; a main scanning unit that causes the head member to move in a main scanning direction relatively to a medium to which the liquid is ejected; a sub scanning unit that causes the medium to move in a sub scanning direction relatively to the head member, the sub scanning direction being perpendicular to the main scanning direction; a driving-signal outputting unit that outputs a driving signal for each of the plurality of liquid ejecting units; and a mode-selecting part that selects one from a normal mode and a high-speed black mode; wherein the plurality of nozzles forms n rows of nozzles extending in parallel with the sub scanning direction, n being three or more; a black liquid is adapted to be supplied to one row of nozzles among the n rows of nozzles; color liquids are adapted to be supplied to the other rows of nozzles among the n rows of nozzles, the color liquids being different for each of the other rows of nozzles; an arrangement pitch of nozzles is the same for each of the rows of nozzles; positions of m rows of nozzles among the n rows of nozzles are shifted in the sub scanning direction by every 1/m of the arrangement pitch of nozzles for each of the m rows of nozzles, m being not less than three and not more than n;

when the normal mode is selected by the mode-selecting part, the controlling unit being adapted to control the main scanning unit and the sub scanning unit: so as to cause the medium to move in the sub scanning direction relatively to the head member by 1/m of the arrangement pitch of nozzles, after each of first to (m−1)-th movements in the scanning direction of the head member relatively to the medium; and to cause the medium to move in the sub scanning direction relatively to the head member by a difference between a nozzle-row pitch in the sub scanning direction and (m−1)/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles; and the controlling unit being adapted to serve to eject each liquid from each nozzle of each row of nozzles toward the medium, based on ejecting data for each nozzle of each row of nozzles, during each movement in the scanning direction of the head member relatively to the medium;

when the high-speed black mode is selected by the mode-selecting part, the controlling unit being adapted to control the main scanning unit and the sub scanning unit: so as to cause the medium to move in the sub scanning direction relatively to the head member by the nozzle-row pitch in the sub scanning direction, after each movement in the scanning direction of the head member relatively to the medium; and the controlling unit being adapted to serve to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

16. A controlling unit according to claim 15, wherein:

when the high-speed black mode is selected by the mode-selecting part, the controlling unit serves to eject each liquid from each nozzle of each row of nozzles in such a manner that a relative proportion of volume of the ejected liquid coincides with a predetermined proportion.

17. A program executed by a computer system including at least a computer in order to materialize a controlling unit in the computer system, the controlling unit controlling a liquid ejecting apparatus including: a head member having a plurality of nozzles; a plurality of liquid ejecting units, each of which ejects a liquid in each of the plurality of nozzles; a main scanning unit that causes the head member to move in a main scanning direction relatively to a medium to which the liquid is ejected; a sub scanning unit that causes the medium to move in a sub scanning direction relatively to the head member, the sub scanning direction being perpendicular to the main scanning direction; a driving-signal outputting unit that outputs a driving signal for each of the plurality of liquid ejecting units; and a mode-selecting part that selects one from a normal mode and a high-speed black mode; wherein the plurality of nozzles forms n rows of nozzles extending in parallel with the sub scanning direction, n being three or more; a black liquid is adapted to be supplied to one row of nozzles among the n rows of nozzles; color liquids are adapted to be supplied to the other rows of nozzles among the n rows of nozzles, the color liquid being different for each of the other rows of nozzles; an arrangement pitch of nozzles is the same for each of the rows of nozzles; positions of m rows of nozzles among the n rows of nozzles are shifted in the sub scanning direction by every 1/m of the arrangement pitch of nozzles for each of the m rows of nozzles, m being not less than three and not more than n;

when the normal mode is selected by the mode-selecting part, the controlling unit being adapted to control the main scanning unit and the sub scanning unit: so as to cause the medium to move in the sub scanning direction relatively to the head member by 1/m of the arrangement pitch of nozzles, after each of first to (m−1)-th movements in the scanning direction of the head member relatively to the medium; and to cause the medium to move in the sub scanning direction relatively to the head member by a difference between a nozzle-row pitch in the sub scanning direction and ((m−1))/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles; and the controlling unit being adapted to serve to eject each liquid from each nozzle of each row of nozzles toward the medium, based on ejecting data for each nozzle of each row of nozzles, during each movement in the scanning direction of the head member relatively to the medium;

when the high-speed black mode is selected by the mode-selecting part, the controlling unit being adapted to control the main scanning unit and the sub scanning unit: so as to cause the medium to move in the sub scanning direction relatively to the head member by the nozzle-row pitch in the sub scanning direction, after each movement in the scanning direction of the head member relatively to the medium; and the controlling unit being adapted to serve to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

18. A program including a command for controlling a second program operable in a computer system including at least a computer, the program being executed by the computer system to control the second program to materialize a controlling unit in the computer system, the controlling unit controlling a liquid ejecting apparatus including: a head member having a plurality of nozzles; a plurality of liquid ejecting units, each of which ejects a liquid in each of the plurality of nozzles; a main scanning unit that causes the head member to move in a main scanning direction relatively to a medium to which the liquid is ejected; a sub scanning unit that causes the medium to move in a sub scanning direction relatively to the head member, the sub scanning direction being perpendicular to the main scanning direction; a driving-signal outputting unit that outputs a driving signal for each of the plurality of liquid ejecting units; and a mode-selecting part that selects from a normal mode and a high-speed black mode; wherein the plurality of nozzles forms n rows of nozzles extending in parallel with the sub scanning direction, n being three or more; a black liquid is adapted to be supplied to one row of nozzles among the n rows of nozzles; color liquids are adapted to be supplied to the other rows of nozzles among the n rows of nozzles, the color liquids being different for each of the other rows of nozzles; an arrangement pitch of nozzles is the same for each of the rows of nozzles; positions of m rows of nozzles among the n rows of nozzles are shifted in the sub scanning direction by every 1/m of the arrangement pitch of nozzles for each of the m rows of nozzles, m being not less than three and not more than n;

when the normal mode is selected by the mode-selecting part, the controlling unit being adapted to control the main scanning unit and the sub scanning unit: so as to cause the medium to move in the sub scanning direction relatively to the head member by 1/m of the arrangement pitch of nozzles, after each of first to ((m−1))-th movements in the scanning direction of the head member relatively to the medium; and to cause the medium to move in the sub scanning direction relatively to the head member by a difference between a nozzle-row pitch in the sub scanning direction and ((m−1))/m of the arrangement pitch of nozzles, after a m-th movement in the scanning direction of the head member relatively to the medium, the nozzle-row pitch corresponding to a product of the number of nozzles in each row of nozzles and the arrangement pitch of nozzles; and the controlling unit being adapted to serve to eject each liquid from each nozzle of each row of nozzles toward the medium, based on ejecting data for each nozzle of each row of nozzles, during each movement in the scanning direction of the head member relatively to the medium;

when the high-speed black mode is selected by the mode-selecting part, the controlling unit being adapted to control the main scanning unit and the sub scanning unit: so as to cause the medium to move in the sub scanning direction relatively to the head member by the nozzle-row pitch in the sub scanning direction, after each movement in the scanning direction of the head member relatively to the medium; and the controlling unit being adapted to serve to eject the black liquid from each nozzle of the row of nozzles to which the black liquid is supplied, toward the medium, based on ejecting data for each nozzle of the row of nozzles, and to eject the color liquids from each corresponding nozzle of the other rows of nozzles toward the medium, based on the ejecting data.

19. A liquid ejecting apparatus comprising a head member including a plurality of rows of nozzles for ejecting liquid, wherein the plurality of rows of nozzles includes at least n rows of nozzles in a main scanning direction, which is a relative movement direction of the head member and a medium to which the liquid is ejected when the liquid is ejected, n being three or more;

the nozzles in each row of nozzles are arranged in a sub scanning direction at the same common pitch, the sub scanning direction being perpendicular to the main scanning direction, positions of m rows of nozzles among the at least n rows of nozzles are shifted in the sub scanning direction by every 1/m of the pitch for each of the m rows of nozzles, m being not less than three and not more than n, a black liquid is adapted to be supplied to one row of nozzles among the rows of nozzles, color liquids are adapted to be supplied to the other rows of nozzles among the rows of nozzles, a normal mode and a high-speed black mode are selectively used, in the normal mode, liquid ejected from each row of nozzles is adapted to be interpolated by the liquid ejected from the row of nozzles, by every 1/m of the pitch, in the sub scanning direction, and in the high-speed black mode, the black liquid is adapted to be interpolated by the color liquids, by every 1/m of the pitch, in the sub scanning direction.

20. A liquid ejecting apparatus according to claim 19, wherein four rows of nozzles are included in the head member, two rows of nozzles among the four rows of nozzles are arranged in the same manner in the sub scanning direction.

* * * * *